US012577072B2

(12) United States Patent
Ichikawa et al.

(10) Patent No.: US 12,577,072 B2
(45) Date of Patent: Mar. 17, 2026

(54) FILM ROLL REPLACEMENT DEVICE, FILM ROLL SUPPLY METHOD, AND FILM ROLL REMOVAL METHOD

(71) Applicant: ISHIDA CO., LTD., Kyoto (JP)

(72) Inventors: Makoto Ichikawa, Ritto (JP); Satoshi Hashimoto, Ritto (JP); Masayuki Yamane, Ritto (JP); Yuchuan Tong, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 265 days.

(21) Appl. No.: 18/351,504

(22) Filed: Jul. 13, 2023

(65) Prior Publication Data

US 2024/0017949 A1 Jan. 18, 2024

(30) Foreign Application Priority Data

Jul. 15, 2022 (JP) ..... 2022-113759

(51) Int. Cl.
*B65H 19/12* (2006.01)

(52) U.S. Cl.
CPC . *B65H 19/123* (2013.01); *B65H 2301/41745* (2013.01); *B65H 2801/81* (2013.01)

(58) Field of Classification Search
None
See application file for complete search history.

(56) References Cited

U.S. PATENT DOCUMENTS 5,285,978 A * 2/1994 Sakano ..... B65H 19/123 242/562
11,649,083 B2 * 5/2023 Tong ..... B65B 41/18 53/64
2003/0034419 A1 * 2/2003 Joutsjoki ..... B65H 19/126 242/533.7

(Continued)

FOREIGN PATENT DOCUMENTS

EP 0524828 B1 12/1995
JP 2002-337817 A 11/2002

(Continued)

OTHER PUBLICATIONS

The Search Report from the corresponding European Patent Application No. 23185338.3 issued on Dec. 13, 2023.

(Continued)

*Primary Examiner* — William A. Rivera
(74) *Attorney, Agent, or Firm* — United IP Counselors, LLC

(57) ABSTRACT

A film roll replacement device supplies a film roll to a bag making and packaging machine, which has a film-roll-supporting part to support the film roll and which manufactures bags containing articles using the film. The film roll replacement device includes a holding section, the driving unit, and a controller. The holding section is located adjacent to the bag making and packaging machine, and the holding section holds the film roll supplied to the bag making and packaging machine. The driving unit moves the holding section. The controller controls an action of the driving unit (Continued)

to move the holding section to move in a first direction toward the supporting part of the bag making and packaging machine and to transfer the film roll held by the holding section to the supporting part.

11 Claims, 19 Drawing Sheets

(56) References Cited

U.S. PATENT DOCUMENTS

| | | | | |
|---|---|---|---|---|
| 2011/0079357 | A1* | 4/2011 | Ishii | H01L 21/67132 156/510 |
| 2012/0048987 | A1* | 3/2012 | Pellengo Gatti | B65H 19/2276 242/597.5 |
| 2016/0114996 | A1* | 4/2016 | Jendroska | B65H 19/305 242/533.7 |
| 2018/0086488 | A1* | 3/2018 | Campbell | B65B 45/00 |
| 2018/0141772 | A1 | 5/2018 | Prankl et al. | |
| 2020/0108960 | A1* | 4/2020 | Shimoda | B65B 51/16 |

FOREIGN PATENT DOCUMENTS

| | | | |
|---|---|---|---|
| JP | 2005-231789 | A | 9/2005 |
| JP | 2006-199488 | A | 8/2006 |
| JP | 4480383 | B2 | 6/2010 |
| JP | 6692425 | B2 | 5/2020 |
| WO | 2016/173853 | A1 | 11/2016 |

OTHER PUBLICATIONS

Aug. 19, 2025 Reason for Submission of Information Statement by Third Party in Japanese Patent Application No. JP2022-113759, 7 pages; JP.

* cited by examiner

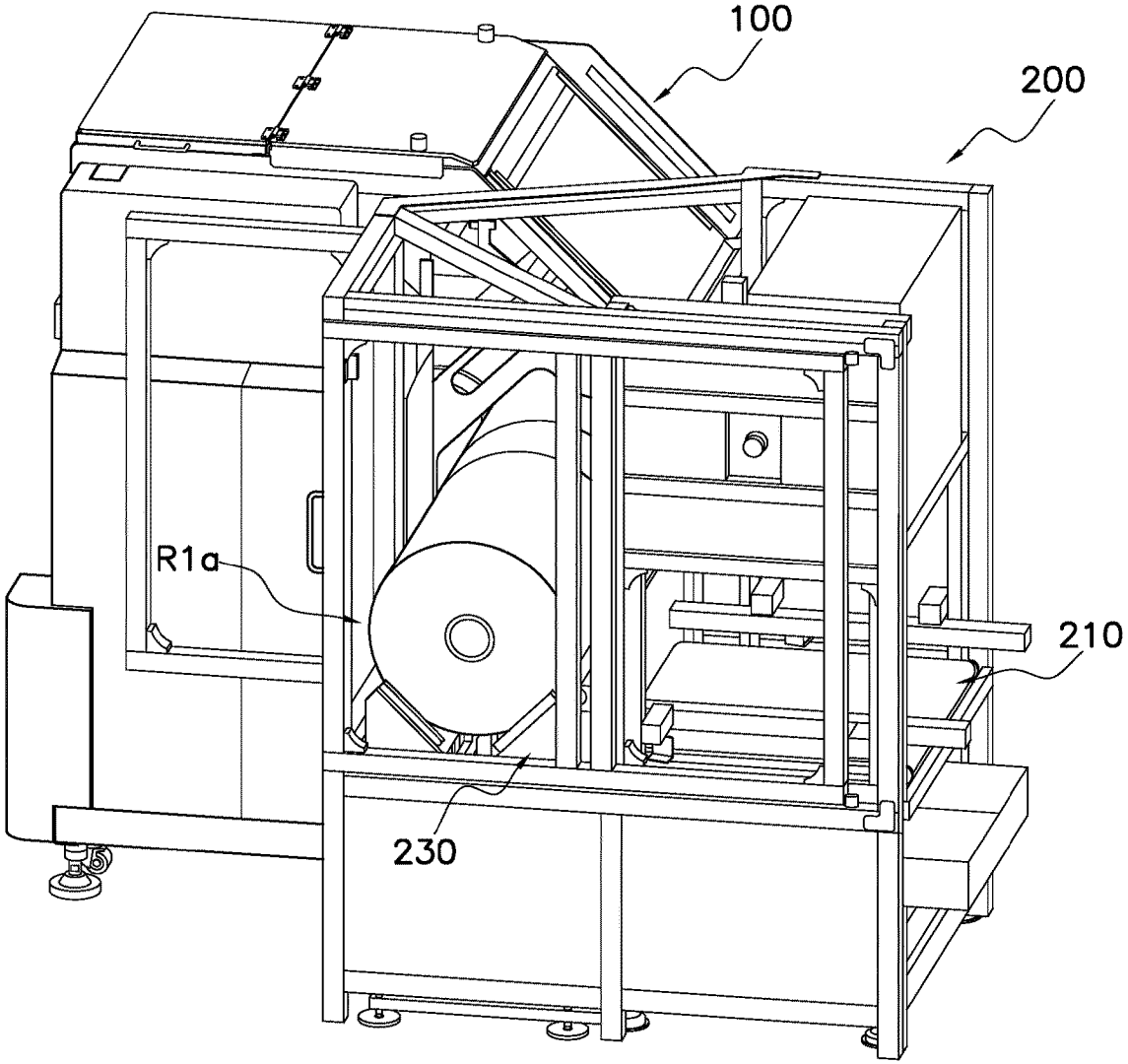
FIG. 4
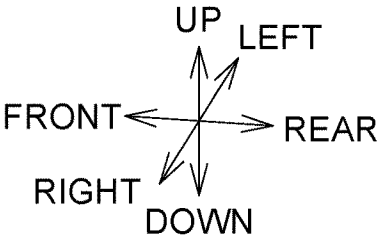

FILM ROLL REPLACEMENT DEVICE, FILM ROLL SUPPLY METHOD, AND FILM ROLL REMOVAL METHOD

CROSS-REFERENCE TO RELATED APPLICATION

This application is based on and claims the priority benefit of Japanese patent application No. 2022-113759 filed Jul. 15, 2022, the contents of which are incorporated herein by reference.

TECHNICAL FIELD

The present application relates to a film roll replacement device to supply a film roll to a bag making and packaging machine, a film roll supply method, and a film roll removal method.

BACKGROUND ART

Bag making and packaging machines, which package articles using film paying out from a film roll to manufacture bags containing the articles, are known, as in Patent Literature 1 (Japanese Laid-open Patent Publication No. 2002-337817).

Conventionally, attaching a film roll to such a bag making and packaging machine has been done manually by a worker, as is described in Patent Literature 1 (Japanese Laid-open Patent Publication No. 2002-337817).

SUMMARY OF THE INVENTION

However, when attaching a film roll is done manually, the worker needs to perform the work of replacing film rolls every time when replacing the film rolls, and there is a great burden on the worker.

The object of the claimed invention is providing a film roll replacement device that can reduce the burden of the work of supplying a film roll to a bag making and packaging machine.

A film roll replacement device according to a first aspect of the claimed invention is configured to supply a film roll, in which a film is wound around a hollow winding core, to a bag making and packaging machine that has a film-roll-supporting part to support the film roll and that uses the film to manufacture bags containing articles. The film roll replacement device comprises a holding section, a holding-section-driving unit, and a control unit. The holding section is configured to be located adjacent to the bag making and packaging machine, and the holding section is configured to hold the film roll supplied to the bag making and packaging machine. The holding-section-driving unit is configured to move the holding section. The control unit is configured to control an action of the holding-section-driving unit to move the holding section in a first direction toward the film-roll-supporting part of the bag making and packaging machine and transfer the film roll held by the holding section to the film-roll-supporting part.

The film roll replacement device according to the first aspect automatically supplies a film roll to the bag making and packaging machine, and the burden on a worker with regard to the work of supplying the film roll to the bag making and packaging machine can therefore be reduced.

A film roll replacement device according to a second aspect of the claimed invention is the film roll replacement device of the first aspect, further comprising a first pushing member and a first-pushing-member-driving unit configured to move the first pushing member. The control unit is configured to control an action of the first-pushing-member-driving unit to move the film roll to the film-roll-supporting part by making the first pushing member push an end surface of the film roll held by the holding section.

In the film roll replacement device according to the second aspect, because the first pushing member pushes and moves the film roll, the film roll can be accurately transferred to a predetermined position on the film-roll-supporting part.

A film roll replacement device according to a third aspect of the claimed invention is the film roll replacement device of the second aspect, wherein the first pushing member is configured to push at least an end surface of the winding core in the end surface of the film roll.

In the film roll replacement device of the third aspect, because the first pushing member pushes the winding core, deformation of the film roll (deformation in which part of the film is displaced from the winding core in an axial direction of the winding core) is suppressed more readily than if the first pushing member were to push only a portion of the film.

A film roll replacement device according to a fourth aspect of the claimed invention is the film roll replacement device of the third aspect, wherein the film-roll-supporting part has a supporting shaft that is configured to be inserted into the hollow winding core and that is configured to support the film roll. A recess conforming to an outer shape of the supporting shaft is formed in the first pushing member.

In the film roll replacement device of the fourth aspect, because the recess conforming to the outer shape of the supporting shaft is formed in the first pushing member, a comparatively wide portion of the end surface of the winding core can be pushed near the supporting shaft by the first pushing member without bringing the first pushing member into contact with the supporting shaft, and the film roll can thus be pushed to a far position onto the supporting shaft.

A film roll replacement device according to a fifth aspect of the claimed invention is the film roll replacement device of any of the second to fourth aspects, wherein the holding-section-driving unit is further configured to function as a first-pushing-member-driving unit. The holding-section-driving unit is configured to move the holding section and the first pushing member together in the first direction.

In the film roll replacement device of the fifth aspect, because the holding-section-driving unit that drives the holding section also functions as the first-pushing-member-driving unit to drive the first pushing member, the number of instruments constituting the film roll replacement device can be reduced.

A film roll replacement device according to a sixth aspect of the claimed invention is the film roll replacement device of any of the second to fifth aspects, comprising a second pushing member and a second-pushing-member-driving unit configured to move the second pushing member in an up-down direction. The holding section has a first end portion located on a side farther from the film-roll-supporting part in the first direction, and a second end portion located on a side nearer to the film-roll-supporting part, on the side opposite to the first end portion. The first pushing member is located adjacent to the first end portion. The second pushing member is located adjacent to the second end portion. The controller is further configured to, after making the first pushing member push the end surface of the film roll held by the holding section and moving the film roll to the film-roll-supporting part, control an action of the second-pushing-member-driving unit to move the second pushing member to a height position where the second pushing member is configured to contact with the end surface of the film roll moved to the film-roll-supporting part, and control the action of the holding-section-driving unit to push the end surface of the film roll by the second pushing member and to move the film roll in the first direction.

In the film roll replacement device of the sixth aspect, a region over which the holding section can move in a direction along the first direction can be suppressed by using the first pushing member and the second pushing member, and a width of the film roll replacement device in the first direction can therefore be suppressed.

A film roll replacement device according to a seventh aspect of the claimed invention is the film roll replacement device of any of the first to sixth aspects, comprising a third pushing member and a third-pushing-member-driving unit configured to move the third pushing member in a second direction opposite to the first direction. The control unit is further configured to control an action of the third-pushing-member driving unit to move the film roll to the holding section by making the third pushing member push the end surface of the film roll supported by the film-roll-supporting part.

In the film roll replacement device of the seventh aspect, a depleted film roll (a film roll with no film left or mostly no film left, i.e., on the order of 97% or 98% depleted) or a film roll that has ceased to be used without being depleted (a film roll with film left) can be automatically removed using the third pushing member.

A film roll replacement device according to an eighth aspect of the claimed invention is the film roll replacement device of the seventh aspect, wherein the film-roll-supporting part has a supporting shaft that is configured to be inserted into the hollow winding core and that is configured to support the film roll. A recess conforming to an outer shape of the supporting shaft is formed in the third pushing member.

In the film roll replacement device of the eighth aspect, because the recess conforming to the outer shape of the supporting shaft is formed in the third pushing member, a comparatively wide portion of the end surface of the winding core can be pushed near the supporting shaft by the third pushing member and the winding core can be removed from the supporting shaft without bringing the third pushing member into contact with the supporting shaft, even when substantially no film is left on the film roll.

A film roll replacement device according to a ninth aspect of the claimed invention is the film roll replacement device of the seventh aspect, further comprising an up-down direction driving unit and a measuring unit. The up-down direction driving unit is configured to move the holding section in an up-down direction. The measuring unit is configured to measure a distance in the up-down direction between the holding section and a surface of the film roll supported by the film-roll-supporting part. The control unit is further configured to control an action of the up-down direction driving unit to adjust a height position of the holding section based on the distance measured by the measuring unit before the film roll supported by the film-roll-supporting part is moved to the holding section.

In the film roll replacement device of the ninth aspect, it is possible to suppress the incidence of events such as the film roll supported by the film-roll-supporting part falling onto the holding section from a high position and the holding section being damaged.

A film roll replacement device according to a tenth aspect of the claimed invention is the film roll replacement device of any of the seventh to ninth aspects, wherein the holding-section-driving unit is further configured to function as the third-pushing-member-driving unit. The holding-section-driving unit is configured to move the holding section and the third pushing member together in the second direction when moving the film roll to the holding section by pushing the end surface of the film roll supported by the film-roll-supporting part with the third pushing member.

In the film roll replacement device of the tenth aspect, because the holding-section-driving unit to drive the holding section also functions as the third-pushing-member-driving unit to drive the third pushing member, the number of instruments constituting the film roll replacement device can be reduced.

A film roll replacement device according to an eleventh aspect of the claimed invention is the film roll replacement device of any of the seventh to tenth aspects, further comprising a retrieval section where the winding core of the depleted film roll is retrieved. The holding section has a gap formed therein through which the winding core of the depleted film roll moved from the film-roll-supporting part is configured to fall to the retrieval section.

In the film roll replacement device of the eleventh aspect, the depleted film roll, having been automatically removed from the film-roll-supporting part, can be withdrawn from the holding section.

A film roll replacement device according to a twelfth aspect of the claimed invention is the film roll replacement device of the eleventh aspect, wherein a stopper is placed in the gap of the holding section. The stopper is configured to move between a first position where the winding core is prevented from falling into the retrieval section and a second position where the winding core is allowed to fall into the retrieval section.

In the film roll replacement device of the twelfth aspect, it is possible to suppress, inter alia, a film roll (winding core) from falling from the gap in the holding section at an unintended timing, or a film roll not to be retrieved in the retrieval section from falling into the retrieval section.

A film roll supply method according to a thirteenth aspect of the claimed invention is a method of supplying a film roll, in which a film is wound around a hollow winding core, using a film roll replacement device, to a bag making and packaging machine that has a film-roll-supporting part configured to support the film roll and that is configured to use the film to manufacture bags containing articles. The film roll replacement device has a holding section and a holding-section-driving unit. The holding section is configured to be located adjacent to the bag making and packaging machine, and the holding section is configured to hold the film roll supplied to the bag making and packaging machine. The holding-section-driving unit is configured to move the holding section. The film roll supply method comprises a step in which the holding-section-driving unit moves the holding section in a first direction toward the film-roll-supporting part of the bag making and packaging machine to transfer the film roll held by the holding section to the film-roll-supporting part.

In the film roll supply method according to the thirteenth aspect, the film roll is automatically supplied to the bag making and packaging machine, and the burden on a worker with regard to the work of supplying the film roll to the bag making and packaging machine can therefore be reduced.

A film roll removal method according to a fourteenth aspect of the claimed invention is a method of removing a film roll, in which a film is wound around a hollow winding core, using a film roll replacement device, from a bag making and packaging machine that has a film-roll-supporting part to support the film roll and that uses the film to manufacture bags containing articles. The film roll replacement device has a holding section located adjacent to the bag making and packaging machine, a holding-section-driving unit configured to move the holding section, a pushing member, a pushing-member-driving unit configured to move the pushing member, and a measuring unit configured to measure a distance between the holding section and a surface of the film roll supported by the film-roll-supporting part. The film roll removal method comprises a step in which the holding-section-driving unit moves the holding section to be below the film-roll-supporting part. The film roll removal method also comprises a step in which the measuring unit measures the distance between the holding section and the surface of the film roll supported by the film-roll-supporting part. The film roll removal method also comprises a step in which the holding-section-driving unit adjusts a height of the holding section based on the distance measured by the measuring unit. The film roll removal method also comprises a step in which the pushing-member-driving unit drives the pushing member to bring the pushing member into contact with an end surface of the film roll supported by the film-roll-supporting part. The film roll removal method also includes a step in which the pushing-member-driving unit drives the pushing member to push the end surface of the film roll in a first direction and the holding-section-driving unit moves the holding section in the first direction from below the film-roll-supporting part, so as to move the film roll supported by the film-roll-supporting part to the holding section.

In the film roll removal method according to the fourteenth aspect, a depleted film roll (a film roll with no film left or a film roll with mostly no film left) or a film roll that has ceased to be used without being depleted (a film roll with film left) can be automatically removed from the bag making and packaging machine.

In the film roll replacement device and the film roll supply method according to the claimed invention, a burden on a worker with regard to the work of supplying a film roll to a bag making and packaging machine can be reduced because the film roll is automatically supplied to the bag making and packaging machine.

In the film roll removal method according to the claimed invention, a depleted film roll or a film roll that has ceased to be used without being depleted can be automatically removed from a bag making and packaging machine.

BRIEF DESCRIPTION OF THE DRAWINGS

FIG. 4 is a schematic perspective view of the film supply section of the bag making and packaging machine of FIG. 1 and the film roll replacement device according to one embodiment of the claimed invention, as seen from the right rear;

DESCRIPTION OF EMBODIMENTS

A film roll replacement device 200 according to one embodiment of a film roll supply device of the present disclosure shall now be described with reference to the drawings.

The following description is merely a specific example of the claimed invention, and does not limit the technical scope of the claimed invention. It will be understood that various changes in configuration and detail can be made without departing from the spirit and scope of the invention as set forth in the claims.

In the following description, expressions such as parallel, perpendicular, horizontal, vertical, orthogonal, identical, etc., may be used. Meanings of these expressions are not limited to strictly parallel, perpendicular, horizontal, vertical, orthogonal, identical, etc., may also be substantially parallel, perpendicular, horizontal, vertical, orthogonal, identical, etc.

For the sake of convenience, expressions such as "front (front surface)," "rear (back surface)," "up," "down," "left," and "right" may be used to indicate directions in the following description. Unless otherwise specified, these directional expressions represent the directions of the arrows added to the drawings.

(1) Bag Making and Packaging Machine and Weighing and Packaging System

Figure 1:
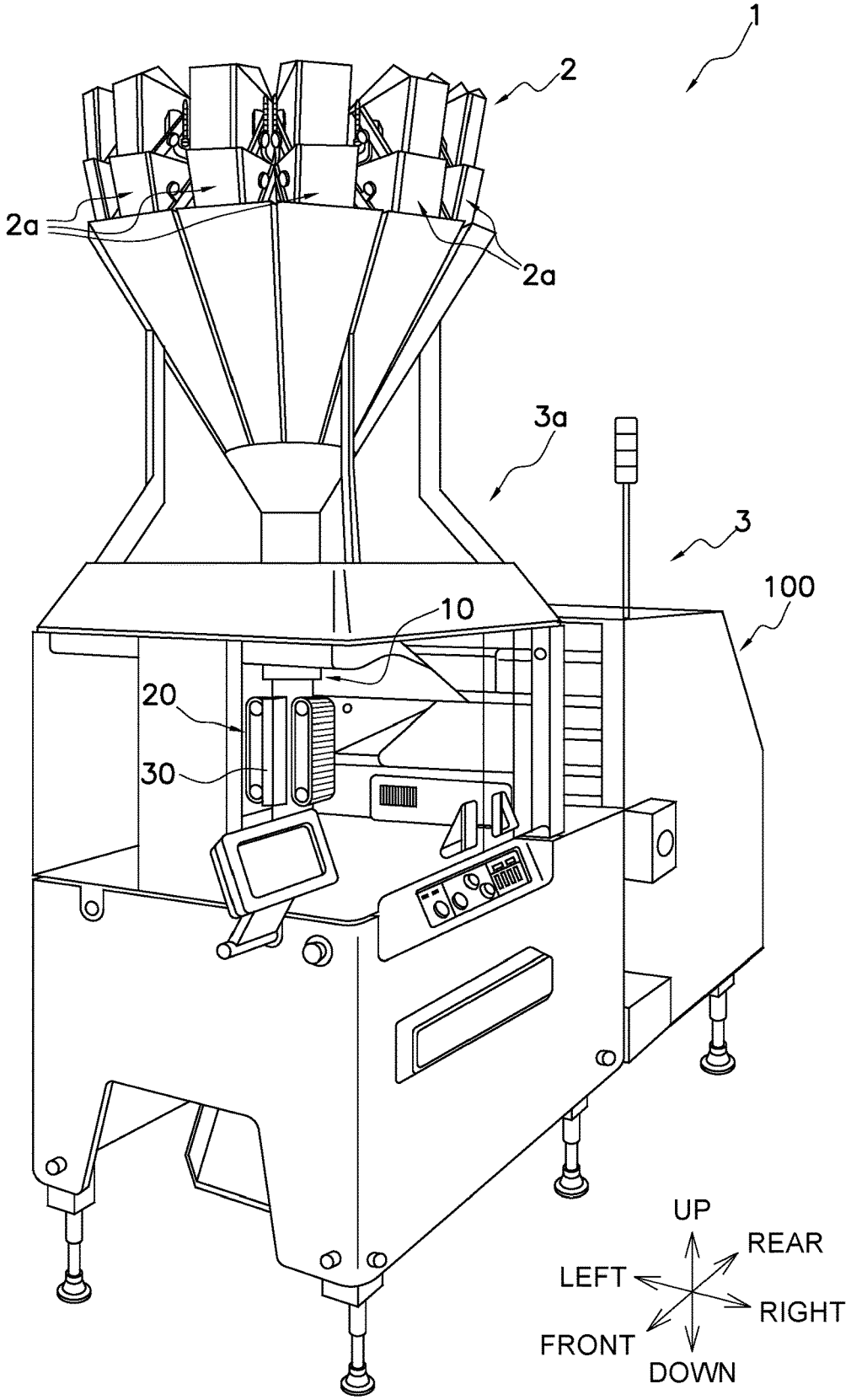
FIG. 1 is a schematic perspective view of a weighing and packaging system including a bag making and packaging machine to which a film roll is supplied by a film roll replacement device according to one embodiment of a film roll supply device of the claimed invention.
Figure 2:
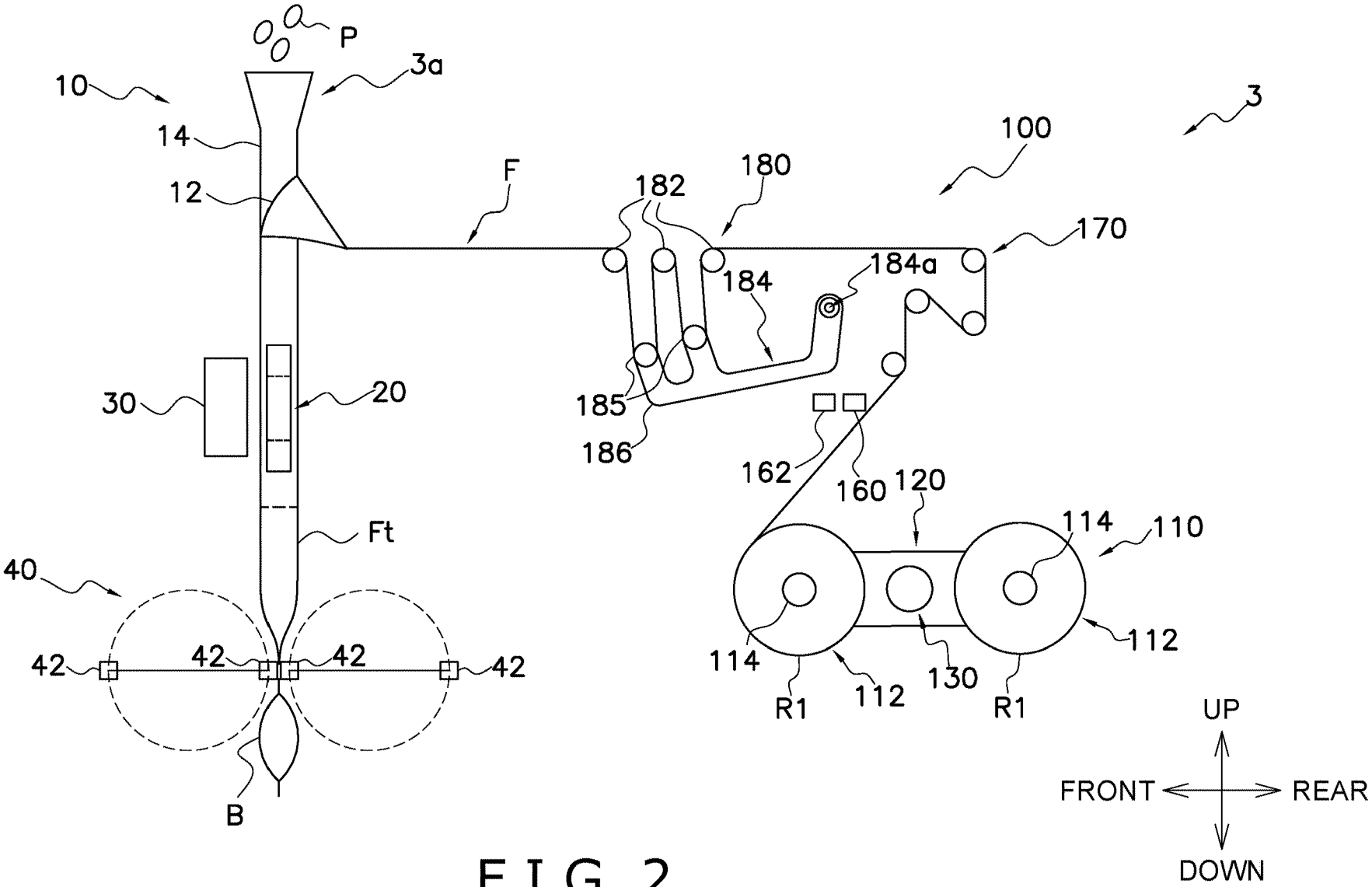
FIG. 2 is a schematic diagram of the bag making and packaging machine of FIG. 1.

First, a bag making and packaging machine 3, to which the film roll replacement device 200 supplies a film roll, and a weighing and packaging system 1 including the bag making and packaging machine 3, shall now be described with reference to FIGS. 1, 2, and 7. FIG. 1 is a schematic perspective view of the weighing and packaging system 1. FIG. 2 is a schematic diagram of the bag making and packaging machine 3. A control block diagram of the bag making and packaging machine 3 is shown in the lower part of FIG. 7.

The weighing and packaging system 1 mainly has a combination weighing machine 2 and the bag making and packaging machine 3 (see FIG. 1).

(1-1) Combination Weighing Machine

The combination weighing machine 2 mainly has a plurality of weighing hoppers 2*a* as in FIG. 1. The combination weighing machine 2 uses the plurality of weighing hoppers 2*a* to weigh articles P (e.g., potato chips) of a predetermined weight, and supplies the articles to the bag making and packaging machine 3 positioned thereunder. Specifically, the combination weighing machine 2 conveys and supplies articles P supplied from a supply conveyor (not shown in the figure) or the like to the plurality of weighing hoppers 2*a* using a conveying means (not shown in the figure). The combination weighing machine 2 measures the weight of the articles P supplied to each of the weighing hoppers 2*a* using a weighing means (not shown in the figure). The combination weighing machine 2 selects a combination of weighing hoppers 2*a* so that the total value of weight of the articles P in the selected weighing hoppers 2*a* will fall within a predetermined weight range. The combination weighing machine 2 supplies articles P of a predetermined weight to the bag making and packaging machine 3 by downwardly discharging the articles P in weighing hoppers 2*a* selected in a combination.

(1-2) Bag Making and Packaging Machine

The bag making and packaging machine 3 receives the supply of articles P from the combination weighing machine 2, forms a bag B from a sheet-shaped film F, and manufactures a bag B containing the articles P therein, as shown in FIG. 2. The bag making and packaging machine 3 mainly includes a bag making and packaging section 3*a*, a film supply section 100, and a packaging machine controller 4, as shown in FIGS. 1, 2, and 7.

The film supply section 100 holds a film roll R1 around which the sheet-shaped film F is wound, and supplies the film F paying out from the film roll R1 to the bag making and packaging section 3*a*. The bag making and packaging section 3*a* receives the supply of articles P from the combination weighing machine 2 and forms the sheet-shaped film F supplied from the film supply section 100 to manufacture bags B containing the articles P. The packaging machine controller 4 controls actions of various components of the bag making and packaging machine 3.

(1-2-1) Bag Making and Packaging Section

The bag making and packaging section 3*a* mainly includes a forming mechanism 10, a film-conveying device 20, a vertical seal mechanism 30, and a lateral seal mechanism 40, as shown in FIG. 2.

The forming mechanism 10 mainly includes a tube 12 and a former 14, as shown in FIG. 2. The tube 12 is a cylindrical member that is open at upper and lower ends. Articles supplied by the combination weighing machine 2 are dropped into the opening at the upper end of the tube 12 (see FIG. 2). The former 14 is positioned so as to surround the tube 12. The former 14 forms the sheet-shaped film F conveyed by the film supply section 100 into a tube shape, and forms a tubular film Ft having overlapping ends in a direction orthogonal to the conveying direction of the film F.

The film-conveying device 20 conveys the film F supplied from the film supply section 100. Specifically, the film-conveying device 20 uses suction to hold the tubular film Ft via a pair of belts (not shown in the figure) having a suction function, and conveys the belts downward to convey the tubular film Ft and the sheet-shaped film Ft on the upstream side.

The vertical seal mechanism 30 seals the tubular film Ft along the vertical direction. The vertical seal mechanism 30 is positioned in front of the tube 12 as in FIG. 2. The overlapping portion of the film F of the tubular film Ft is sandwiched between the vertical seal mechanism 30 and the tube 12, and in this state, the overlapping portion of the film F is heat sealed by a heater (not shown in the figure) of the vertical seal mechanism 30.

With the articles P having been dropped to a bottom part of the tubular film Ft, the lateral seal mechanism 40 sandwiches the tubular film Ft between a pair of sealing jaws 42 having heaters installed therein, heat-seals the tubular film Ft along a direction orthogonal to the conveying direction, and manufactures a bag B containing the articles P. A cutter (not shown in the figure) is built into one of the pair of sealing jaws 42 to seal the tubular film Ft. When laterally sealing the tubular film Ft, the lateral seal mechanism 40 uses the cutter to cut the tubular film Ft at a heightwise center position of the portion laterally sealed by the sealing jaws 42, and separating the bag containing the articles P from the following tubular film Ft.

(1-2-2) Film Supply Section

The film supply section 100 is provided behind and adjacent to the bag making and packaging section 3*a* as in FIG. 1, and supplies the sheet-shaped film F to the forming mechanism 10 of the bag making and packaging section 3*a*. The film supply section 100 mainly includes a holding mechanism 110, a support frame 120, a frame shaft 130, a joining mechanism 160, a cutting mechanism 162, a plurality of rollers 170, and a tension-adjusting mechanism 180.

The holding mechanism 110 includes a pair of supporting parts 112 and a support-shaft-driving unit 116. Each of the pair of supporting parts 112 holds a film roll R1 in which a film F is wound around a hollow winding core WC. The film supply section 100 supplies the bag making and packaging section 3*a* with film F paying out from the film rolls R1 held by the supporting parts 112.

Due to the holding mechanism 110 having a plurality (e.g., two in this case) of supporting parts 112, the holding mechanism 110 can simultaneously hold a replacement film roll R1 in addition to the film roll R1 supplying film F to the bag making and packaging section 3*a* (the film roll R1 in use). Therefore, when the film F of the film roll R1 in use has been used up, manufacture of bags B can be restarted in a short period of time by using the film F of the replacement film roll R1.

The supporting parts 112 shall now be described in detail. The supporting parts 112 each have a supporting shaft 114 extending in a left-right direction. Film rolls R1 are mounted on the supporting shafts 114, and the mounted film rolls R1 are supported. Specifically, the film rolls R1 are mounted on the supporting shafts 114 by inserting the supporting shafts 114 through the winding cores WC of the film rolls R1. Air chucks (not shown in the figure) or other fixing mechanisms are provided to the supporting shafts 114.

The film rolls R1 are fixed to the supporting shafts 114 by driving the fixing mechanisms in a state in which the supporting shafts 114 have been inserted through the hollow winding cores WC of the film rolls R1. The support-shaft-driving unit 116 of the film supply section 100 may, for example, be a motor provided for both of the supporting shafts 114, and the support-shaft-driving unit 116 causes the supporting shafts 114 to rotate so that the film rolls R1 mounted on the supporting shafts 114 are caused to rotate.

The support frame 120 is an arm-shaped member that supports the pair of supporting parts 112. The support frame 120 is mounted at the center thereof on the frame shaft 130. The supporting parts 112 are mounted at both ends of the arm-form support frame 120 such that the frame shaft 130 is disposed between the supporting parts 112.

When the frame shaft 130 is caused to rotate by a motor or another frame-driving unit 132, the support frame 120 rotates together with the frame shaft 130, and the supporting shafts 114 of the pair of supporting parts 112 rotate about a center axis of the frame shaft 130. Due to the support frame 120 rotating about the center axis of the frame shaft 130, the supporting shafts 114 of the pair of supporting parts 112 are moved to respective film roll a replacement position, a film supply position, or other positions. The film roll replacement position is a position at which film roll R1 is supplied by the film roll replacement device 200 to the supporting shafts 114. The film supply position is a position at which the film F is paying out from the film rolls R1 supported by the supporting shafts 114 to the bag making and packaging section 3*a*.

A leading end (the end opposite the side fixed to the winding core WC) of the film F of the replacement film roll R1 mounted on one of the pair of supporting shafts 114 is set in a predetermined position. When the film F of the film roll R1 in use (the film roll R1 mounted on the other supporting shaft 114) is used up (when the remaining amount of the film F becomes equal to or less than a predetermined amount), the joining mechanism 160 controlled by the packaging machine controller 4 joins a vicinity of a trailing end (an end fixed to the winding core WC) of the film F of the film roll R1 in use (in other words, the depleted film roll R1) and a vicinity of the leading end of the film F of the replacement film roll R1. In addition, the cutting mechanism 162 controlled by the packaging machine controller 4 cuts the film F of the depleted film roll R1 on the side toward the depleted film roll R1 from the location where the film is joined to the film F of the replacement film roll R1. As a step of splicing the film F and a step of cutting the film F of the depleted film roll R1 are automatically performed, the burden on the worker when a film roll R1 has been used up can be reduced in the bag making and packaging machine 3.

The film F paying out from the film roll R1 supported on the supporting shaft 114 located in the film supply position is guided by a plurality of rollers 170 located along a predetermined film-conveying path of the film supply section 100, and conveyed to the forming mechanism 10 of the bag making and packaging section 3*a*.

The film-conveying path of the film supply section 100 is provided with a tension-adjusting mechanism 180 that adjusts the magnitude of tension applied to the conveyed film F.

Figure 7:
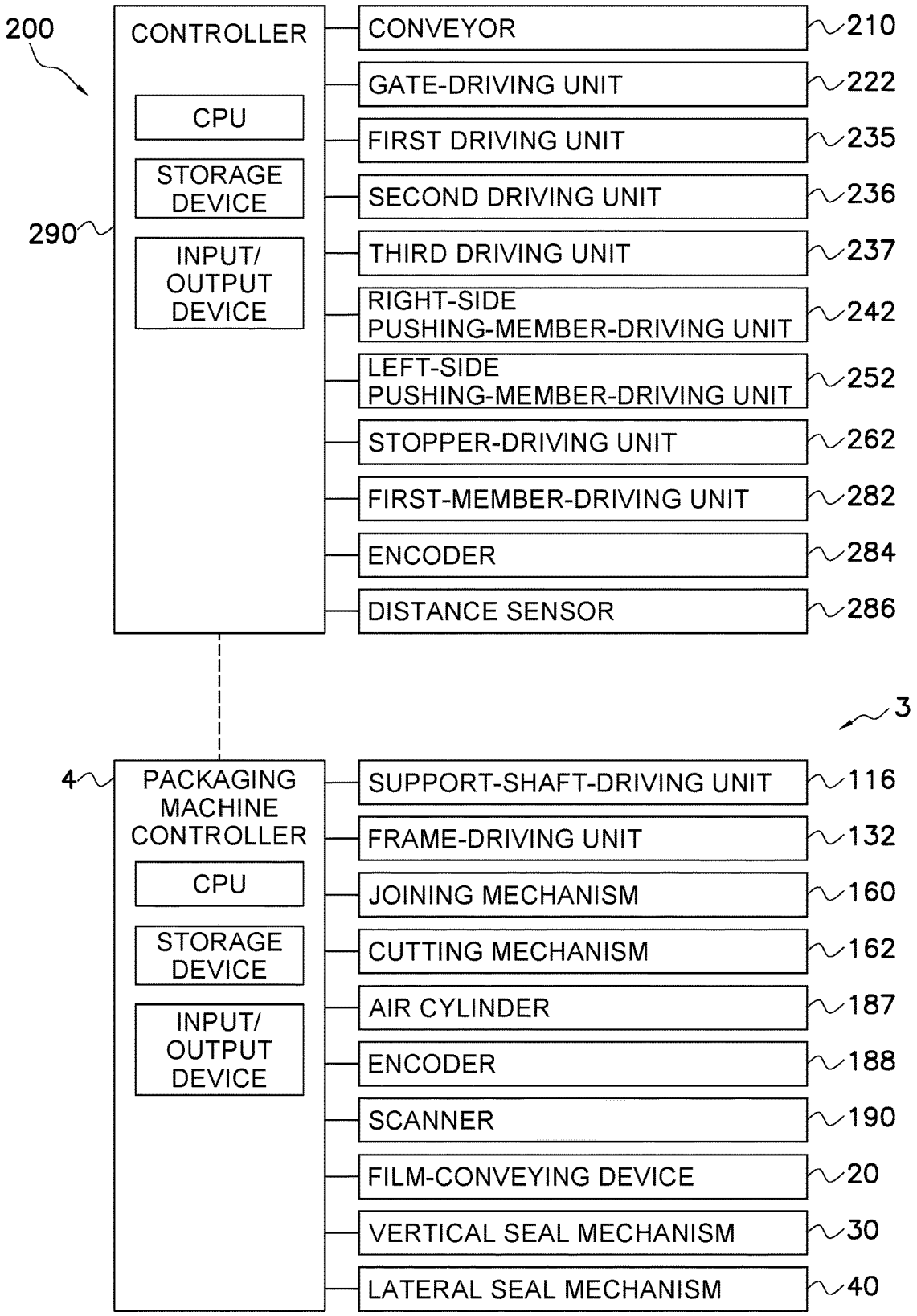
FIG. 7 is a control block diagram of the bag making and packaging machine and the film roll replacement device.

The tension-adjusting mechanism 180 mainly has three fixed rollers 182, a movable roller mechanism 184, a shaft 184*a*, an air cylinder 187, and an encoder 188 (see FIGS. 2 and 7). The movable roller mechanism 184 includes two movable rollers 185 and a pair of arms 186 that support the movable rollers 185 (see FIG. 2). The pair of arms 186 are located to the left and right of the movable rollers 185 so that the movable rollers 185, extending in the left-right direction, are held between the arms 186, and the arms 186 support ends of the movable rollers 185. The pair of arms 186 are rotatably supported by the shaft 184*a* extending in the left-right direction. A tip of a rod (not shown in the figure) entering and exiting a cylinder (not shown in the figure) of the air cylinder 187 is linked to an arm (not shown in the figure) extending in a radial direction from the shaft 184*a*. Driving the air cylinder 187 generates a force that causes the shaft 184*a* to rotate.

The fixed rollers 182 are fixed to a frame (not shown in the figure) and do not change positions. The movable rollers 185 change positions in accordance with the movement of the arms 186 between which the movable rollers 185 are mounted. The fixed rollers 182 and the movable rollers 185 are located in the film-conveying path via which the film F paying out from the film rolls R1 supported by the supporting shafts 114 of the supporting parts 112 moves toward the forming mechanism 10 of the bag making and packaging section 3*a*. The film F is wound on the fixed rollers 182 and the movable rollers 185, which guide the film F being conveyed along the film-conveying path. The movable rollers 185 move in accordance with the force exerted on the movable rollers 185 by the film F wound on the movable rollers 185.

One end of the shaft 184*a* is mounted to the encoder 188, which is for detecting a rotation angle of the shaft 184*a*. The encoder 188 senses the movements of the movable rollers 185. Detection results of the encoder 188 are used in, inter alia, control of the positions of the movable rollers 185 by the packaging machine controller 4.

(1-2-3) Packaging Machine Controller

The packaging machine controller 4 is a device that controls the actions of the components of the bag making and packaging machine 3. The packaging machine controller 4 has, for example, a CPU, storage devices such as a main storage device and an auxiliary storage device, an input/output device, and various electric circuits and electronic circuits. In the packaging machine controller 4, the CPU reads and executes programs stored in memory, whereby the actions of the components of the bag making and packaging section 3*a* and the film supply section 100 are controlled.

Specifically, the packaging machine controller 4 is electrically connected to the film-conveying device 20, the vertical seal mechanism 30, and the lateral seal mechanism 40 of the bag making and packaging section 3*a* as shown in FIG. 7, and the packaging machine controller 4 controls the actions of these components. The packaging machine controller 4 is also electrically connected to the support-shaft-driving unit 116, the frame-driving unit 132, the joining mechanism 160, the cutting mechanism 162, and the air cylinder 187 of the film supply section 100, and the packaging machine controller 4 controls the actions of these components. In addition, the packaging machine controller 4 is electrically connected to the encoder 188 and a scanner 190 of the film supply section 100, and the packaging machine controller 4 receives signals transmitted by these instruments. The scanner 190 is a device that reads codes such as bar codes and matrix-type two-dimensional codes added to the film rolls R1.

During normal operation in which the bag making and packaging section 3*a* manufactures bags B, the packaging machine controller 4 controls actions of the support-shaft-driving unit 116, the air cylinder 187, the film-conveying device 20, the vertical seal mechanism 30, and the lateral seal mechanism 40 in the following manner.

The packaging machine controller 4 controls the film-conveying device 20 so that the sheet-shaped film F paying out from the film rolls R1 is conveyed at a predetermined speed using the support-shaft-driving unit 116. The packaging machine controller 4 controls driving/stopping of the support-shaft-driving unit 116 and the speed at which the film rolls R1 are caused to rotate by the support-shaft-driving unit 116, based on the conveyed state of the film F and the sensing results of the encoder 188. In addition, the packaging machine controller 4 controls the air cylinder 187 so that the movable rollers 185 exert a constant force on the film F being conveyed. Furthermore, the packaging machine controller 4 controls actions of the vertical seal mechanism 30 and the lateral seal mechanism 40 so that the vertical seal mechanism 30 vertically seals the tubular film Ft at a predetermined timing and the lateral seal mechanism 40 laterally seals the tubular film Ft at a predetermined timing.

Details of the control performed by the packaging machine controller 4 when the film roll replacement device 200 supplies a film roll R1 to the bag making and packaging machine 3 shall now be described together with a description of the film roll replacement device 200.

(2) Film Roll Supply Device (2-1) Overall Summary

A summary of the film roll replacement device 200 according to one embodiment of the claimed invention shall now be described with reference to FIGS. 3 to 9.

Figure 3:
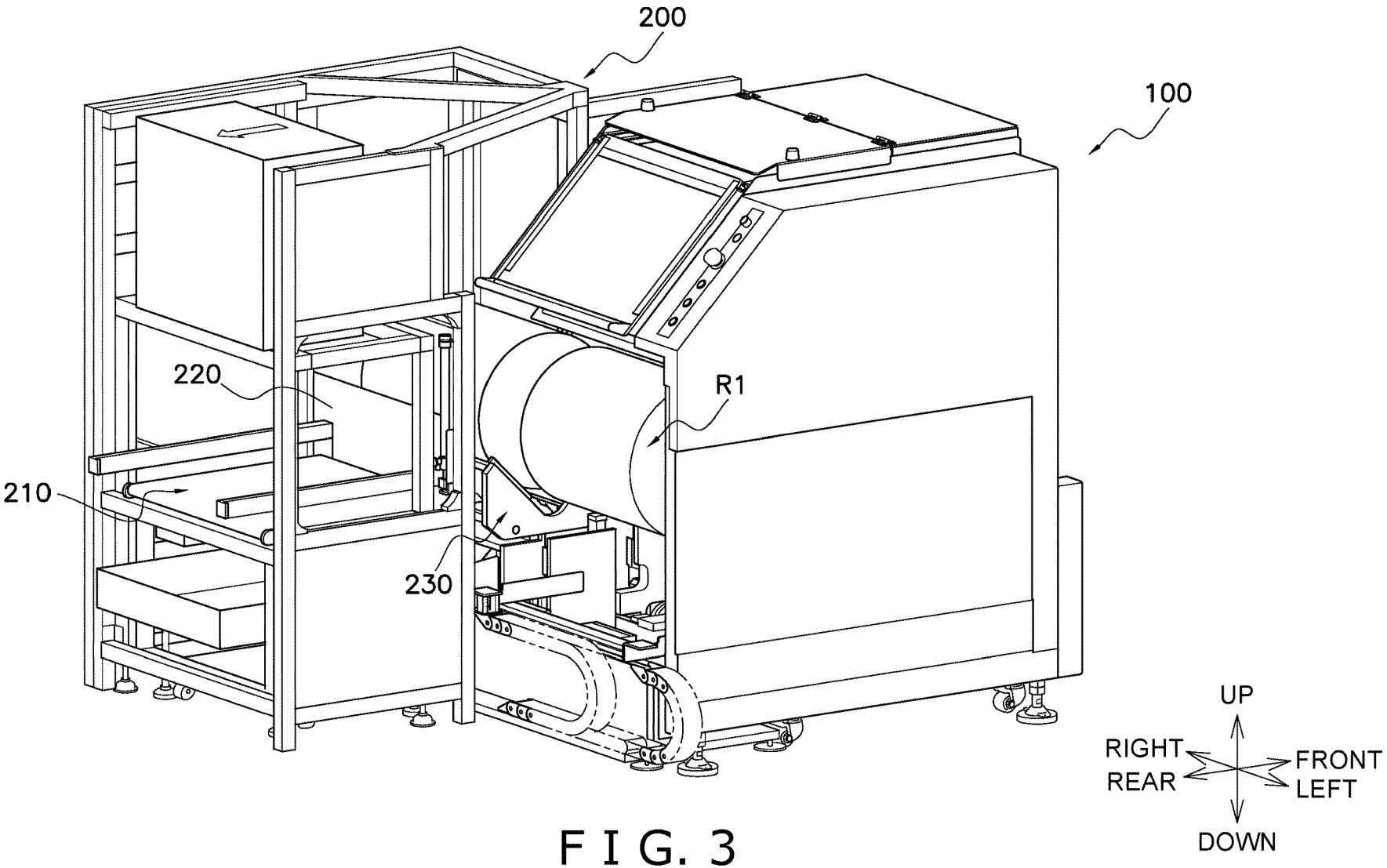
FIG. 3 is a schematic perspective view of a film supply section of the bag making and packaging machine of FIG. 1 and the film roll replacement device according to one embodiment of the claimed invention, as seen from the left rear.
Figure 5:
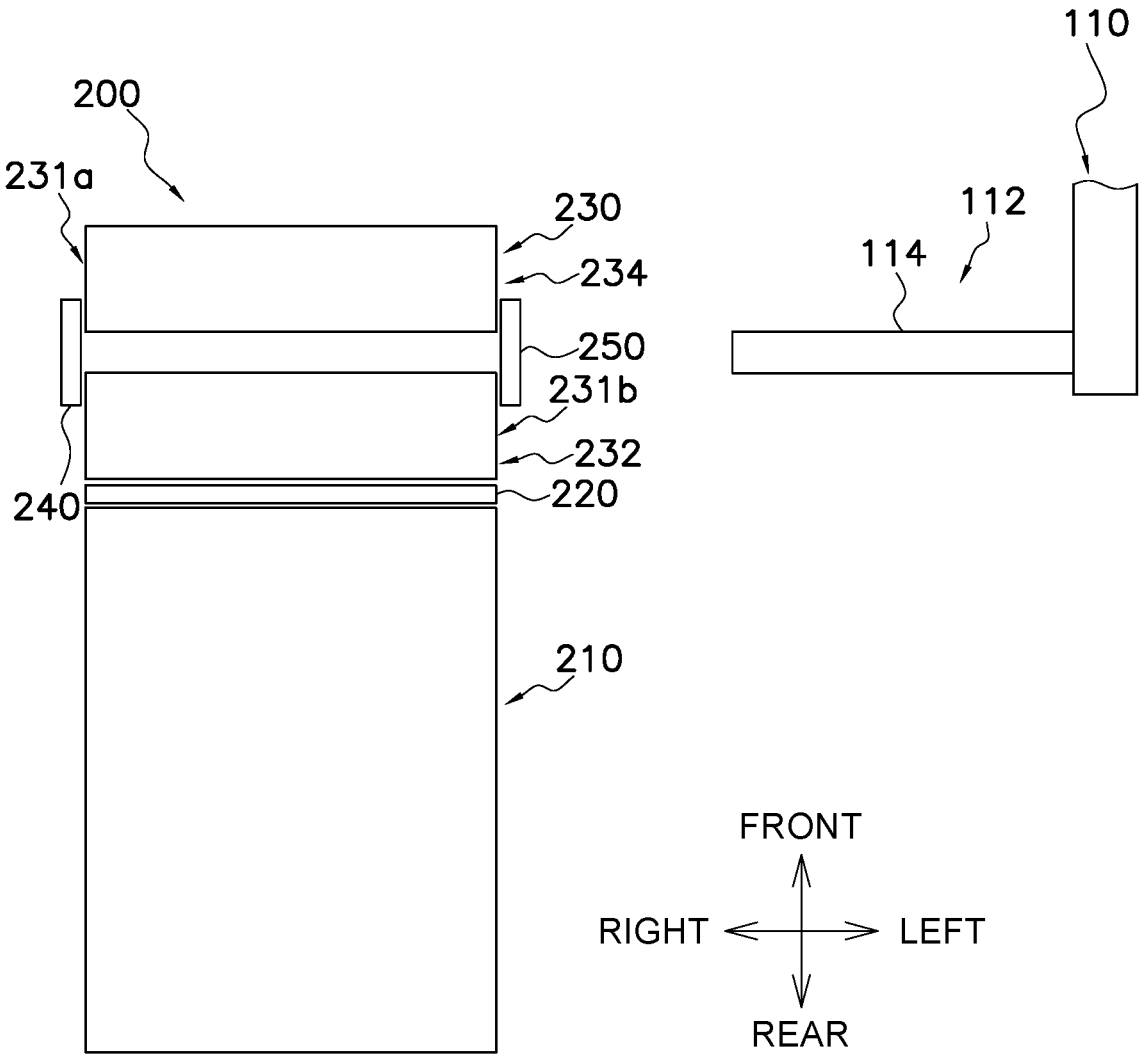
FIG. 5 is a schematic plan view of the film roll replacement device.
Figure 6:
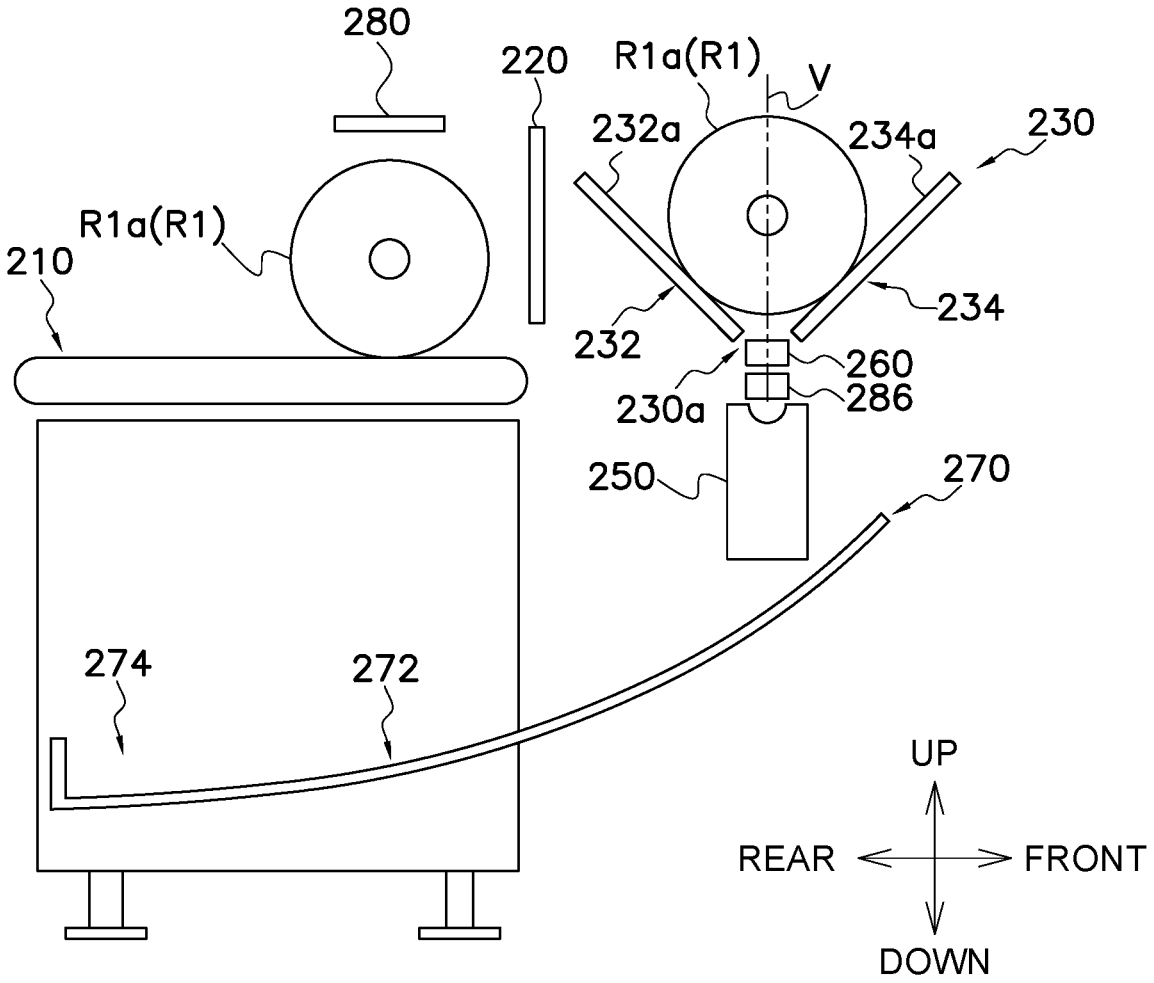
FIG. 6 is a schematic left-side view of the film roll replacement device.
Figure 8:
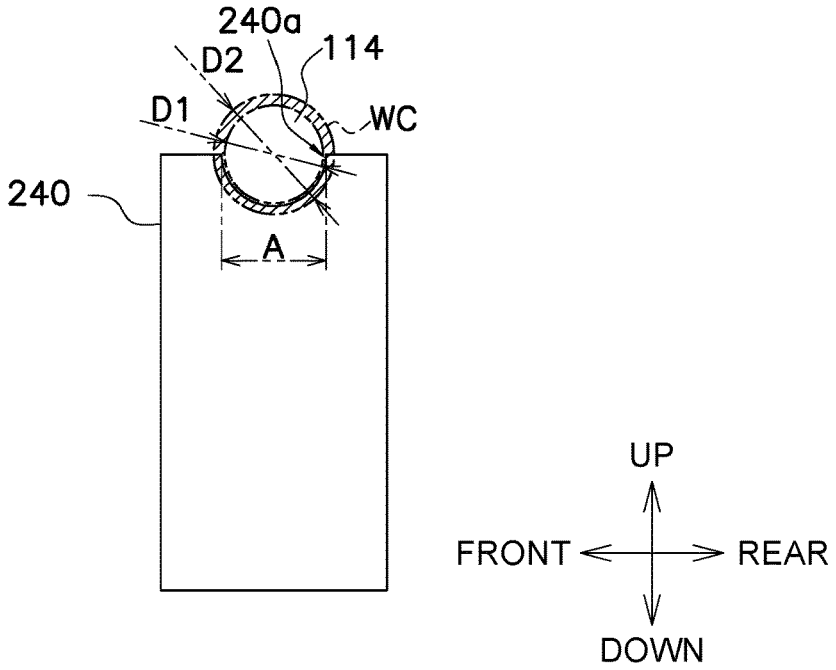
FIG. 8 is a schematic right-side view of a right-side pushing member of the film roll replacement device.
Figure 9:
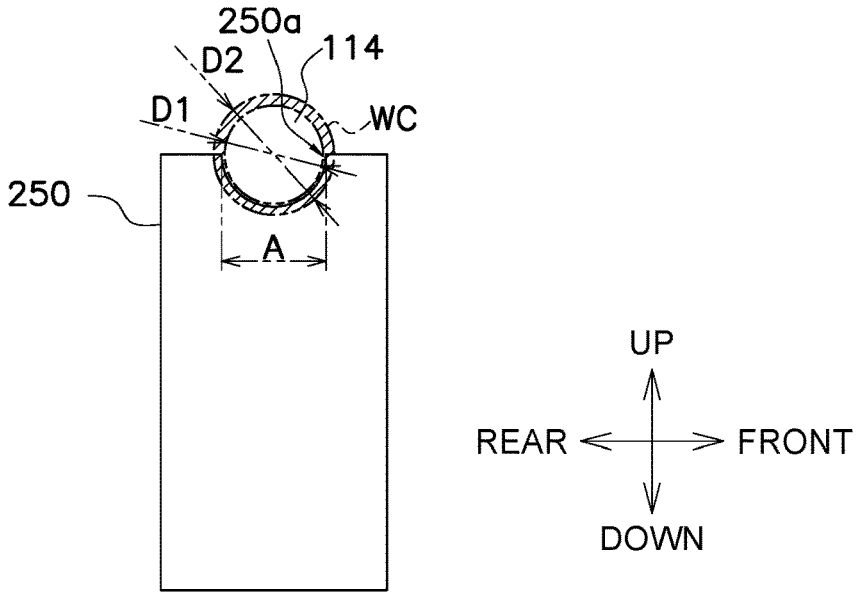
FIG. 9 is a schematic left-side view of a left-side pushing member of the film roll replacement device.

FIG. 3 is a schematic perspective view of the film supply section 100 of the bag making and packaging machine 3 and the film roll replacement device 200 as seen from the left rear. FIG. 4 is a schematic perspective view of the film supply section 100 of the bag making and packaging machine 3 and the film roll replacement device 200 as seen from the right rear. FIG. 5 is a schematic plan view of the film roll replacement device 200. FIG. 6 is a schematic left-side view of the film roll replacement device 200. A control block diagram of the film roll replacement device 200 is shown in the upper part of FIG. 7. FIG. 8 is a schematic right-side view of a right-side pushing member 240 of the film roll replacement device 200. FIG. 9 is a schematic left-side view of a left-side pushing member 250 of the film roll replacement device 200.

The film roll replacement device 200 supplies film rolls R1 to the bag making and packaging machine 3. For the sake of clarity in the description below, a film roll R1 supplied by the film roll replacement device 200 to the bag making and packaging machine 3 may be referred to as a first film roll R1*a*.

In the present disclosure, the film roll replacement device 200 removes a depleted film roll R1 or a partially used film roll R1 from a supporting shaft 114 of the bag making and packaging machine 3. The term "depleted film roll R1" means a film roll R1 in which the film F wound around the winding core WC has been used up (the remaining amount of the film F has become equal to or less than a predetermined amount). The term "partially used film roll R1" means a film roll R1 that is no longer used in the bag making and packaging machine 3 at least temporarily even though the film F has not been used up. For the sake of clarity in explanation below, a film roll R1 removed from the supporting shaft 114 of the bag making and packaging machine 3 may be referred to as a second film roll R1*b*.

The film roll replacement device 200 may be a device that has only the function of supplying film rolls R1 to the bag making and packaging machine 3. In this case, the second film roll R1*b* may be manually removed from the supporting shaft 114 by a worker.

The film roll replacement device 200 is placed, for example, on the right side of the film supply section 100 of the bag making and packaging machine 3, as in FIGS. 3 and 4. The placement of the film roll replacement device 200 depicted in FIGS. 3 and 4 is merely one example, and may be changed as appropriate in accordance with the specifications of the bag making and packaging machine 3 and the film roll replacement device 200.

The film roll replacement device 200 has a conveyor 210, a gate 220, a holding section 230, a right-side pushing member 240, a left-side pushing member 250, a stopper 260, a winding-core-retrieving mechanism 270, and a first member 280, as shown in FIGS. 5 and 6. In addition, the film roll replacement device 200 has a gate-driving unit 222, a first driving unit 235, a second driving unit 236, a third driving unit 237, a right-side pushing-member-driving unit 242, a left-side pushing-member-driving unit 252, a stopper-driving unit 262, a first-member-driving unit 282, an encoder 284, a distance sensor 286, and a controller 290 as shown in FIG. 7. The driving units 222, 235, 236, 237, 242, 252, 262, 282 are motors, air cylinders, and other machines for actuating objects to be driven. The types of machines to use for the driving units 222, 235, 236, 237, 242, 252, 262, 282 may be selected as appropriate.

Details of the various components of the film roll replacement device 200 are described below.

(2-2) Details (2-2-1) Conveyor

The conveyor 210 forwardly conveys the first film roll R1*a*, which is to be supplied to the bag making and packaging machine 3, to the holding section 230. A worker may supply the first film roll R1*a* to the conveyor 210, or an automatic guided vehicle (AGV) for conveying the film roll R1*a* may supply the first film roll R1*a* to the conveyor 210.

In the present embodiment, the conveyor 210 is a belt conveyor that drives a conveyor belt by a motor (not shown in the figure) to convey the film rolls R1. However, the type of conveyor 210 is not limited to a belt conveyor; the conveyor 210 may be a roller conveyor that does not have a drive source. Even in this case, for example, if an end portion of the conveyor 210 on the holding section 230 side is lower than an end portion of the conveyor 210 on the side opposite to the holding section 230, the film rolls R1 can be conveyed to the holding section 230 even without a person moving the film rolls R1. The conveyor 210 may be omitted from the film roll replacement device 200. If there is no conveyor 210, the AGV may directly convey and supply the first film roll R1*a* to the holding section 230. Alternatively, a worker may directly supply the first film roll R1*a* to the holding section 230.

(2-2-2) Gate

The gate 220 is placed in front of the conveyor 210 and to the rear of the holding section 230 as shown in FIG. 5. In other words, the gate 220 is placed between the conveyor 210 and the holding section 230 in a plan view as shown in FIG. 5.

The gate 220 is a member that restricts the movement of the first film roll R1*a* on the conveyor 210, and prevents the first film roll R1*a* from moving to the holding section 230 at unintended timings. The gate 220 is driven by the gate-driving unit 222 to move between a position (restricting position) of restricting the movement of the first film roll R1*a* toward the holding section 230 and a position (non-restricting position) of not restricting the movement of the first film roll R1*a* toward the holding section 230.

Matters such as the timing at which the gate-driving unit 222 moves the gate 220 shall now be described hereinafter.

(2-2-3) Holding Section

The holding section 230 is, at least temporarily, placed adjacent to a supporting shaft 114 supporting a film roll R1 in the bag making and packaging machine 3, as shown in FIG. Specifically, the holding section 230 is placed in a position adjacent to the previously described supporting shaft 114 caused to move to the film roll replacement device.

The holding section 230 holds the first film roll R1*a* supplied to the bag making and packaging machine 3. The holding section 230 also holds the second film roll R1*b* removed from the supporting shaft 114.

The holding section 230 has a first end portion 231*a* placed, in the left-right direction, on a far side of the supporting shaft 114 placed in the film roll replacement position, and a second end portion 231*b* placed on the side opposite to the first end portion 231*a*, on a side near the supporting shaft 114 placed in the film roll replacement position, as shown in FIG. 5. The holding section 230 holds the first film roll R1*a* supplied by the conveyor 210 and the second film roll R1*b* removed from the supporting shaft 114 between the first end portion 231*a* and the second end portion 231*b*, in an orientation such that the winding core WC extends in the left-right direction.

The holding section 230 has a first holding member 232 and a second holding member 234 as shown in FIGS. 5 and 6. The first holding member 232 and the second holding member 234 are arranged side by side in the front-rear direction. Specifically, the first holding member 232 is located behind the second holding member 234 (on the conveyor 210 side) as shown in FIGS. 5 and 6. The first holding member 232 and the second holding member 234 are flat members. However, the first holding member 232 and the second holding member 234 are not limited to being flat as long as the holding section 230 can function as described below. The first holding member 232 has a first holding surface 232*a* that supports the first film roll R1*a*, and the second holding member 234 has a second holding surface 234*a* that supports the first film roll R1*a*.

The flat-plate-form first holding member 232 and second holding member 234 are arranged so as to form a V shape in a right-side view, as in FIG. 6. In other words, the first holding member 232 and the second holding member 234 are arranged such that, in a right-side view and a left-side view, the first holding surface 232*a* and the second holding surface 234*a* form a V shape. In yet other words, the first holding member 232 and the second holding member 234 are arranged such that in a view along the axial directions of the supporting shafts 114 of the bag making and packaging machine 3, the first holding surface 232*a* and the second holding surface 234*a* form a V shape. In particular, a line perpendicular to the first holding surface 232*a* and a line perpendicular to the second holding surface 234*a* are orthogonal in this embodiment. However, the line perpendicular to the first holding surface 232*a* and the line perpendicular to the second holding surface 234*a* may form an angle other than 90°.

The first holding member 232 and the second holding member 234 arranged so as to form a V shape are spaced apart such that a gap 230*a* is formed between the first holding member 232 and the second holding member 234 in the trough of the V shape. In other words, the gap 230*a* is formed in a lower part of the holding section 230. A front-rear-directional width of the gap 230*a* is greater than an outer diameter of the winding cores WC of the film rolls R1. The gap 230*a* in the holding section 230 is used to allow passage of the winding core WC of the second film roll Rib, particularly the depleted film roll R1, which has been removed from the supporting shaft 114 and moved to the holding section 230, and to drop and discharge the winding core WC of the depleted film roll R1 into the winding-core-retrieving mechanism 270.

The holding section 230 is driven by the first driving unit 235, the second driving unit 236, and the third driving unit 237.

The first driving unit 235 causes the holding section 230 to rotate about a rotation axis that extends in the left-right direction and that is disposed in a predetermined position. For example, in a left-side view, the first driving unit 235 causes the holding section 230 to rotate about an intersection point X between a straight line imagined as an extension of the first holding surface 232*a* and a straight line imagined as an extension of the second holding surface 234*a* (see FIG. 14). Specifically, the first driving unit 235 changes the orientation of the holding section 230 between a first orientation and a second orientation by causing the holding section 230 to rotate. When the holding section 230 is in the first orientation, the perpendicular line of the first holding surface 232*a* extends vertically and the perpendicular line of the second holding surface 234*a* extends horizontally. The first orientation of the holding section 230 shown here is merely one example. The orientation of the holding section 230 when inclined slightly such that the first holding surface 232*a* lowers from the rear toward the front may be the first orientation of the holding section 230. When the holding section 230 is in the second orientation, the line perpendicular to the first holding surface 232*a* is tilted 45° in relation to a horizontal plane, and the line perpendicular to the second holding surface 234*a* is also tilted 45° in relation to a horizontal plane. When the holding section 230 in the second orientation is viewed from the left, the first holding surface 232*a* is inclined 45° in relation to a vertical plane, and the second holding surface 234*a* is inclined in relation to a vertical plane. In other words, when the holding section 230 in the second orientation is viewed from the left, the first holding surface 232*a* and the second holding surface 234*a* are arranged symmetrically with respect to a vertical plane V spreading in the up-down direction and the left-right direction (see FIG. 6). When the holding section 230 in the second orientation is viewed from the left, the first holding surface 232*a* and the second holding surface 234*a* form an upward-opening V shape.

The second driving unit 236 moves the holding section 230 in the up-down direction.

The third driving unit 237 moves the holding section 230 in the left-right direction. In other words, the third driving unit 237 moves the holding section 230 in the second orientation to the left so as to approach the supporting shaft 114 located in the film roll replacement position, and to the right so as to move away from the supporting shaft 114 located in the film roll replacement position.

The third driving unit 237 of the present embodiment moves the holding section 230, the right-side pushing member 240, and the left-side pushing member 250 simultaneously to the left and right. In other words, the third driving unit 237 moves the holding section 230 integrally with the right-side pushing member 240 and the left-side pushing member 250 to the left and right.

Matters such as the timing at which the first driving unit 235, the second driving unit 236, and the third driving unit 237 move the holding section 230 shall now be described hereinafter.

(2-2-4) Right-Side Pushing Member

The right-side pushing member 240 is a member placed adjacent to the first end portion 231*a* of the holding section 230, as shown in FIG. 5. The right-side pushing member 240 is a member that pushes a right end surface of the first film roll R1*a* held by the holding section 230.

The right-side pushing member 240 is driven in the up-down direction by the right-side pushing-member-driving unit 242. By driving the right-side pushing member 240 in the up-down direction, the right-side pushing-member-driving unit 242 moves the right-side pushing member 240 to a position (referred to as a contact position) where said member can come into contact with an end surface of the first film roll R1*a*. In addition, by driving the right-side pushing member 240 in the up-down direction, the right-side pushing-member-driving unit 242 moves the right-side pushing member 240 to a position (referred to as a non-contact position) where said member does not come into contact with the film rolls R1 mounted on the supporting shafts 114 of the bag making and packaging machine 3.

Furthermore, the right-side pushing member 240 is driven in the left-right direction by the third driving unit 237. In particular, while the right-side pushing member 240 being in the contact position, the third driving unit 237 moves the right-side pushing member 240 to the left so that the right end surface of the first film roll R1*a* held by the holding section 230 is pushed by the right-side pushing member 240, and the first film roll R1*a* is moved leftward toward the supporting shaft 114 located in the film roll replacement position.

There are no particular limitations as to the shape of the right-side pushing member 240; said member has a substantially rectangular shape in a right-side view as in FIG. 8. In an upper part of the right-side pushing member 240 there is preferably formed a recess 240*a* that conforms to a shape of an outer diameter of the supporting shafts 114 of the bag making and packaging machine 3. There are no particular limitations as to the shape; the recess 240*a* is, for example, U-shaped or V-shaped. For example, if the recess 240*a* is U-shaped, the recess 240*a* is substantial rectangular and a lower end part thereof is formed in a semicircular shape in a right-side view. Moreover, if the recess 240*a* is U-shaped, the recess 240*a* may be a semicircular recess in a right-side view as shown in FIG. 8. In the present disclosure, a semicircular recess 240*a* is formed in an upper part of the right-side pushing member 240. Preferably, a diameter A of the semicircle of the recess 240*a* is greater than a diameter D1 of the supporting shaft 114 on which the first film roll R1*a* is mounted, and is less than a diameter D2 of an outer circumference of the winding core WC of the first film roll R1*a*.

Reasoning for providing a recess 240*a* of these dimensions in the upper part of the right-side pushing member 240 shall now be described.

Normally in the first film roll R1*a*, an end surface of the winding core WC of the first film roll R1*a* is located farther to the outside in an axial direction of the winding core WC than the film F wound around the winding core WC. Should a recess 240*a* of the above mentioned dimensions be formed in the upper part of the right-side pushing member 240, the right-side pushing member 240 driven by the third driving unit 237 is able to push only the winding core WC of the first film roll R1*a* if the right-side pushing-member-driving unit 242 moves the right-side pushing member 240 in the up-down direction such that a bottom part of the recess 240*a* in the right-side pushing member 240 comes to be located in a vicinity below a lowest point of the supporting shaft 114 on which the first film roll R1*a* is to be mounted.

Should the film F be wound comparatively loosely around the winding core WC of the first film roll R1*a*, and the right-side pushing member 240 pushes only the portion of the film F at the end surface of the first film roll R1*a*, there is a risk that part of the film F will be misaligned in the left-right direction and the film supply section 100 will not be able to convey the film F to an appropriate position in the bag making and packaging section 3*a*. By contrast, if the right-side pushing member 240 pushes only the end surface of the winding core WC, the left-right-directional misalignment of part of the film F wound around the first film roll R1*a* can be suppressed even if the right-side pushing member 240 pushes the end surface of the first film roll R1*a*.

Even in cases in which the right-side pushing member 240 pushes the portion of the film F at the end surface of the first film roll R1*a* in addition to the end surface of the winding core WC, the left-right-directional misalignment of the film F in the first film roll R1*a* is suppressed by pushing at least the end surface of the winding core WC.

The shape of the right-side pushing member 240 is not limited to the U shape described here. For example, the right-side pushing member 240 may have a shape other than a U shape that can at least push the right end surface of the winding core WC without coming into contact with the supporting shaft 114.

If there are no disadvantages in particular, the right-side pushing member 240 may push only the portion of the film F on the right end surface of the first film roll R1*a*.

The manner in which the right-side pushing-member-driving unit 242 and the third driving unit 237 move the right-side pushing member 240 shall now be described hereinafter.

(2-2-5) Left-Side Pushing Member

The left-side pushing member 250 is a member located adjacent to the second end portion 231*b* of the holding section 230 as shown in FIG. 5. The left-side pushing member 250 is a member that pushes the right end surface of the first film roll R1*a* mounted on a supporting shaft 114 of the bag making and packaging machine 3. In addition, the left-side pushing member 250 is a member that pushes a left end surface of the second film roll R1*b* removed from a supporting shaft 114 of the bag making and packaging machine 3.

The left-side pushing member 250 is driven in the up-down direction by the left-side pushing-member-driving unit 252. By driving the left-side pushing member 250 in the up-down direction, the left-side pushing-member-driving unit 252 moves the left-side pushing member 250 to a position (referred to as a contact position) where said member can come into contact with the end surface of the first film roll R1*a* and the end surface of the second film roll R1*b*. In addition, by driving the left-side pushing member 250 in the up-down direction, the left-side pushing-member-driving unit 252 moves the left-side pushing member 250 to a position (referred to as a non-contact position) where said member does not come into contact with the film rolls R1 mounted on the supporting shafts 114 of the bag making and packaging machine 3.

Furthermore, the left-side pushing member 250 is driven in the left-right direction by the third driving unit 237.

With the left-side pushing member 250 in the contact position and the left-side pushing member 250 located on the right side of the first film roll R1*a*, the third driving unit 237 moves the left-side pushing member 250 to the left. At this time, the left-side pushing member 250 pushes the right end surface of the first film roll R1*a* in which the supporting shaft 114 is inserted into part of a hollow part of the winding core WC, and moves the first film roll R1*a* leftward to a predetermined position on the supporting shaft 114.

In addition, with the left-side pushing member 250 in the contact position and the left-side pushing member 250 located on the left side of the second film roll Rib, the third driving unit 237 moves the left-side pushing member 250 to the right. At this time, the left-side pushing member 250 pushes the left end surface of the second film roll R1*b* in which the supporting shaft 114 is supported, and moves the second film roll R1*b* to the holding section 230.

There are no particular limitations as to the shape of the left-side pushing member 250; said member is substantially rectangular in a left-side view as in FIG. 9. In an upper part of the left-side pushing member 250 is formed a recess 250*a* having the same shape as the recess 240*a* of the right-side pushing member 240. Because the shape of the recess 250*a* is the same as the shape of the recess 240*a*, details of the shape of the recess 250*a* shall not be described. Due to the recess 250*a* being formed in the upper part of the left-side pushing member 250, the left-side pushing member 250 can push the winding core WC of the first film roll R1*a* and the winding core WC of the second film roll R1*b*.

The shape of the left-side pushing member 250 is not limited to a U shape. For example, the left-side pushing member 250 may have a shape other than a U shape that can at least push the right end surface of the winding core WC of the first film roll R1*a* or the left end surface of the winding core WC of the second film roll R1*b* without coming into contact with the supporting shaft 114.

If there are no disadvantages in particular, the left-side pushing member 250 may push only the portion of the film F on the right end surface of the first film roll R1*a*.

There are some cases in which almost no film F remains on the second film roll R1*b* when the second film roll R1*b* is removed from the supporting shaft 114. Therefore, the left-side pushing member 250 preferably pushes at least the left end surface of the winding core WC when the second film roll R1*b* is removed from the supporting shaft 114.

The manner in which the left-side pushing-member-driving unit 252 and the third driving unit 237 move the left-side pushing member 250 shall now be described hereinafter.

(2-2-6) Stopper

The stopper 260 is a member for closing the gap 230*a* in the holding section 230 in the second orientation (see FIG. 6) and preventing the second film roll R1*b* removed from the supporting shaft 114 from falling from the gap 230*a* into the winding-core-retrieving mechanism 270 below.

The stopper 260 is driven by the stopper-driving unit 262 to move between a closed position at which the gap 230*a* is closed and an open position at which the gap 230*a* is not closed. When the stopper 260 is placed in the closed position, the stopper 260 prevents the winding core WC of the second film roll R1*b* from falling into the winding-core-retrieving mechanism 270. When the stopper 260 is placed in the open position, the stopper 260 allows the winding core WC of the second film roll R1*b* to fall into the winding-core-retrieving mechanism 270.

The timings at which the stopper-driving unit 262 moves the stopper 260 shall now be described hereinafter.

(2-2-7) Winding-Core-Retrieving Mechanism

The winding-core-retrieving mechanism 270 is a mechanism that retrieves the second film roll R1*b* removed from the supporting shaft 114 and fallen from the gap 230*a* in the holding section 230 in the second orientation. Particularly, the winding-core-retrieving mechanism 270 is a mechanism for retrieving the winding core WC of a depleted film roll R1 serving as the second film roll R1*b* falling from the gap 230*a* in the holding section 230 in the second orientation.

The second film roll R1*b* fallen from the gap 230*a* in the holding section 230 slides down an inclined surface 272 of the winding-core-retrieving mechanism 270 and is retrieved in a retrieval area 274 directly below the conveyor 210 (see FIG. 6). The manner of retrieving the second film roll R1*b* fallen from the gap 230*a* in the holding section 230 may be designed as appropriate.

(2-2-8) First Member and Encoder

The first member 280 and the encoder 284 are components used to measure a diameter of the first film roll R1*a* supplied to the bag making and packaging machine 3.

The first member 280 is located above the conveyor 210.

The first member 280 is located in a predetermined first position (standby position) when not being used to measure the diameter of the first film roll R1*a*. The first position is a position at which the first member 280 does not come into contact with the first film roll R1*a* conveyed along the conveyor 210, even if the first member 280 had been present in the first position. When the first member 280 is used to measure the diameter of the first film roll R1*a*, the first-member-driving unit 282 downwardly moves the first member 280 to a second position where contact is made with an outer peripheral surface (upper end) of the first film roll R1*a* carried on the conveyor 210.

The first-member-driving unit 282 in this embodiment is a motor to which the encoder 284 is attached. The encoder 284 measures an amount of rotational displacement of the motor when the first-member-driving unit 282 moves the first member 280 from the first position to the second position, and transmits to the controller 290 (described hereinafter) a signal corresponding to the measured amount of rotational displacement.

The controller 290, serving as a first measuring unit, calculates a distance the first member 280 moves from the first position to the second position based on the signal of the encoder 284. Furthermore, the controller 290 measures the diameter of the first film roll R1*a* on the conveyor 210 based on the calculated distance that the first member 280 moves.

(2-2-9) Distance Sensor

The distance sensor 286 is a sensor that contactlessly measures a distance from a predetermined reference position to the outer peripheral surface of the film roll R1. For example, the distance sensor 286 is located directly below the gap 230*a* in the holding section 230. There are no limitations as to the type of the distance sensor 286; for example, the distance sensor 286 is a laser distance sensor. The distance sensor 286 can measure a distance from a reference position where the distance sensor 286 is located to the outer peripheral surface of the film roll R1 carried on the holding section 230, or to the outer peripheral surface of the film roll R1 mounted on the supporting shaft 114.

The application of the distance sensor 286 shall now be described hereinafter.

(2-2-10) Controller

The controller 290 is a device that controls the actions of the components of the film roll replacement device 200. The controller 290 has, for example, a CPU, storage devices such as a main storage device and an auxiliary storage device, an input/output device, and various electric circuits and electronic circuits.

The controller 290 is electrically connected to the conveyor 210, the gate-driving unit 222, the first driving unit 235, the second driving unit 236, the third driving unit 237, the right-side pushing-member-driving unit 242, the left-side pushing-member-driving unit 252, the stopper-driving unit 262, the first-member-driving unit 282, and the encoder 284, as shown in FIG. 7. The controller 290 controls actions of the conveyor 210, the gate-driving unit 222, the first driving unit 235, the second driving unit 236, the third driving unit 237, the right-side pushing-member-driving unit 242, the left-side pushing-member-driving unit 252, the stopper-driving unit 262, and the first-member-driving unit 282. In addition, the controller 290 receives signals output by the encoder 284 and the distance sensor 286. In addition, the controller 290 is communicably connected to the packaging machine controller 4 of the bag making and packaging machine 3.

The controller 290 controls the actions of the components of the film roll replacement device 200 and causes the film roll replacement device 200 to execute actions such as the following due to the CPU executing programs stored in the storage devices.

The controller 290 removes a film roll R1 (the second film roll Rib) that has been used or has experienced interrupted use from the supporting shaft 114. The controller 290 also moves the holding section 230 to align a height position of a center of a replacement film roll R1 (the first film roll R1*a*) held by the holding section 230 and a height position of a center of the supporting shaft 114 on which the first film roll R1*a* is to be mounted. The controller 290 also moves the holding section 230 to the left to move the first film roll R1*a* held by the holding section 230 to a supporting part 112 of the bag making and packaging machine 3 (to the supporting shaft 114 of the supporting part 112).

Figure 10A:
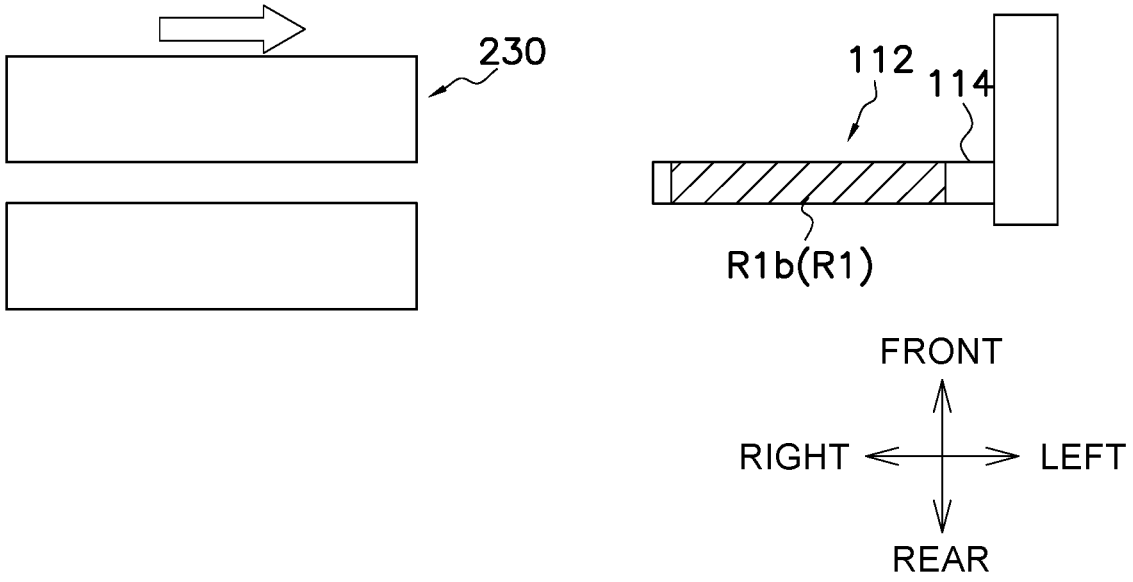
FIG. 10A is a schematic plan view of part of the film roll replacement device and illustrates an action of the film roll replacement device when a film roll is removed from a supporting shaft of the bag making and packaging machine.

Below is a description, made with reference to FIGS. 10A to 13E, of the manner in which the film roll replacement device 200 removes the second film roll Rib from the supporting shaft 114 and mounts the replacement first film roll R1*a* on the supporting shaft 114. FIGS. 10A to 10E are schematic plan views of part of the film roll replacement device 200, and are intended to illustrate the actions of the film roll replacement device 200 when the second film roll R1*b* is removed from the supporting shaft 114 of the bag making and packaging machine 3. FIG. 11 is a schematic left-side view for illustrating the actions of the film roll replacement device 200 when the second film roll R1*b* is removed from the supporting shaft 114 of the bag making and packaging machine 3. FIGS. 12A to 12E are schematic left-side views of part of the film roll replacement device 200 and are intended for illustrating movement of the first film roll Rla to the holding section 230 and adjustment of a height position of the holding section 230. FIGS. 13A to 13E are schematic plan views of part of the film roll replacement device 200 and are intended for illustrating the mounting of the first film roll R1*a* on the supporting shaft 114 of the bag making and packaging machine 3 by the film roll replacement device 200.

(A) Removal of Second Film Roll from Supporting Shaft of Bag Making and Packaging Machine When a request to replace a film roll R1 is transmitted from the packaging machine controller 4, the controller 290 first removes the film roll R1 (second film roll Rib) from the supporting shaft 114 of the bag making and packaging machine 3.

Though not an action of the film roll replacement device 200, the action of the bag making and packaging machine 3 when the packaging machine controller 4 transmits a request to replace a film roll R1 shall first be described. Particularly, the action of the bag making and packaging machine 3 shall now be described regarding when the film F is used up from the film roll R1 that had so far been used in the bag making and packaging machine 3.

The packaging machine controller 4 senses that the film F of the film roll R1 used so far has been used up based on, for example, movement of the movable rollers 185 detected based on a signal output by the encoder 188. Upon sensing that the film F of the film roll R1 has been used up, the packaging machine controller 4 controls the joining mechanism 160 to join the vicinity of the trailing end of the film F of the depleted film roll R1 and the vicinity of the leading end of the film F of the replacement film roll R1. The packaging machine controller 4 also controls the cutting mechanism 162 to cut the film F of the depleted film roll R1 at a predetermined position.

The packaging machine controller 4 then drives the frame-driving unit 132 to move the supporting shaft 114 supporting the replaced film roll R1 (the film roll R1 to be used for packaging from this point onward) to the film supply position and move the supporting shaft 114 supporting the depleted film roll R1 to the film roll replacement position.

At this time, if the frame-driving unit 132 happens to be driven without the film F of the depleted film roll R1 having been cut, there is a risk of an adverse event such as the film F becoming entangled in the rollers 170 of the bag making and packaging machine 3.

Before driving the frame-driving unit 132, the packaging machine controller 4 preferably controls the support-shaft-driving unit 116 to cause the supporting shaft 114 supporting the depleted film roll R1 to rotate in a direction of winding the film F. At this time, if the film F of the depleted film roll R1 and the film F extending toward the bag making and packaging machine 3 remain connected, the movable rollers 185 are moved upward. Therefore, the packaging machine controller 4 can sense based on the sensing result from the encoder 188 that the depleted film roll R1 and the bag making and packaging section 3*a* are connected by the film F pulled out from the depleted film roll R1. When the depleted film roll R1 and the bag making and packaging section 3*a* remain connected by the film F, the packaging machine controller 4 does not perform control to drive the frame-driving unit 132, and, for example, causes the bag making and packaging machine 3 and the film roll replacement device 200 to stop due to an error.

After having moved the supporting shaft 114 supporting the second film roll R1*b* to the film roll replacement position and before transferring the second film roll R1*b* to the holding section 230, the packaging machine controller 4 preferably controls the action of the support-shaft-driving unit 116 to cause the supporting shaft 114 supporting the second film roll R1*b* to rotate and to wind the film F of the second film roll R1*b* on the winding core WC. Due to this configuration, it is possible to suppress adverse events such as when the film F remaining on the second film roll R1*b* is entangled with the various components of the film roll replacement device 200, and the winding core WC of the second film roll R1*b* to be discharged to the winding-core-retrieving mechanism 270 is not discharged to the winding-core-retrieving mechanism 270.

An amount of winding of the film F of the second film roll R1*b* (an amount of rotation of the supporting shaft 114 on which the second film roll R1*b* is mounted) is preferably determined based on a film roll diameter of the second film roll R1*b* so that the film F does not hang down from the second film roll R1*b*.

To realize this objective, for example, the film roll replacement device 200 moves the holding section 230 to be directly below the supporting shaft 114 placed in the film supply position before the packaging machine controller 4 actuates the support-shaft-driving unit 116 in order to wind the film F. The film roll replacement device 200 then causes the distance sensor 286 to measure the distance from the distance sensor 286 to the outer peripheral surface (lowest part) of the second film roll R1*b*. The controller 290 of the film roll replacement device 200 then measures (calculates) the film roll diameter of the second film roll R1*b* based on a value measured by the distance sensor 286 and a positional relationship between the distance sensor 286 and the supporting shaft 114 disposed in the film supply position stored in advance in a storage device. The controller 290 then transmits the measured film roll diameter of the second film roll R1*b* to the packaging machine controller 4. The packaging machine controller 4 determines the winding amount of the film F of the second film roll R1*b* (the rotation amount of the supporting shaft 114) based on the received film roll diameter of the second film roll R1*b* so that the film F does not hang down from the second film roll R1*b*.

In this embodiment, the controller 290 of the film roll replacement device 200 measures the film roll diameter of the second film roll Rib, but as an alternative, the packaging machine controller 4 may measure (calculate) the film roll diameter of the second film roll R1*b* based on the value measured by the distance sensor 286. In this embodiment, the value measured by the distance sensor 286 is used to measure the film roll diameter of the second film roll Rib, but this feature is not provided by way of limitation; for example, the film roll diameter of the second film roll R1*b* may be measured based on a value measured by a distance sensor (not shown in the figure) provided to the bag making and packaging machine 3.

The packaging machine controller 4, for example, transmits a request to replace a film roll R1 to the controller 290 of the film roll replacement device 200 immediately before the action of winding the film F onto the winding core WC of the second film roll R1*b*. The timing at which the packaging machine controller 4 transmits the request to replace a film roll R1 to the controller 290 may be determined as appropriate unless there is no contradiction. For example, if the film roll diameter of the second film roll R1*b* is not measured using the value measured by the distance sensor 286 when the film F is wound onto the winding core WC of the second film roll Rib, the timing at which the packaging machine controller 4 transmits a request to replace a film roll R1 to the controller 290 may occur after the action of winding the film F onto the winding core WC of the second film roll R1*b*.

Now, description of the removal of the second film roll R1*b* from the supporting shaft 114 disposed in the film roll replacement position performed by the film roll replacement device 200 is made, with reference to FIGS. 10A to 10D and FIG. 11. The following description is merely one example of the action of removing the second film roll R1*b* performed by the film roll replacement device 200, and may be changed as appropriate.

It is presumed in the description below that at the point in time depicted in FIG. 10A, there is no film roll R1 on the holding section 230, the holding section 230 is disposed in a position adjacent to the front of the gate 220, and the right-side pushing member 240 and the left-side pushing member 250 are disposed in the non-contact position previously described. Also at the point in time depicted in FIG. 10A, the gap 230*a* in the holding section 230 is closed by the stopper 260.

When the controller 290 receives a request to replace the film roll R1 from the packaging machine controller 4, the controller 290 controls the action of the third driving unit 237 to move the holding section 230 from the position depicted in FIG. 10A, which is adjacent to the gate 220, leftward to a position directly below the supporting shaft 114 disposed in the film roll replacement position of FIG. 10B. At this time, the controller 290 controls the second driving unit 236 to move the holding section 230 to the lowest position in the vertical movable range so that the holding section 230 does not come into contact with the supporting shaft 114 or the second film roll R1*b* mounted on the supporting shaft 114.

When the holding section 230 is located directly below the supporting shaft 114 as in FIG. 10B, the distance sensor 286 measures the distance from the distance sensor 286 to the outer peripheral surface (the lowest part) of the second film roll R1*b*.

Preferably, the packaging machine controller 4, based on the value measured by the distance sensor 286, causes the supporting shaft 114 supporting the second film roll R1*b* to rotate to wind the film F of the second film roll R1*b* onto the winding core WC before the second film roll R1*b* is transferred to the holding section 230, as previously described. The packaging machine controller 4 then causes the fixing mechanism to cease fixing the supporting shaft 114 and the second film roll R1*b* together.

Based on the positional relationship between the distance sensor 286 and the holding section 230 stored in advance in a storage device, and the distance from the distance sensor 286 to the outer peripheral surface of the second film roll Rib, the controller 290 measures the distance in the up-down direction between the holding section 230 (a predetermined representative location on the holding section 230) and the outer peripheral surface of the second film roll R1*b* supported by the supporting shaft 114.

Next, the controller 290 controls the second driving unit 236 and adjusts the height position of the holding section 230 based on the distance in the up-down direction between the holding section 230 and the outer peripheral surface of the second film roll R1*b* supported by the supporting shaft 114. Specifically, the controller 290 controls the second driving unit 236 and moves the holding section 230 near to the second film roll R1*b*.

The controller 290 also controls the action of the left-side pushing-member-driving unit 252 and raises the left-side pushing member 250 to a position (the previously described contact position) where the left-side pushing member 250 does not come into contact with the supporting shaft 114 and the left-side pushing member 250 comes into contact with the winding core WC of the second film roll R1*b*.

Figure 10B:
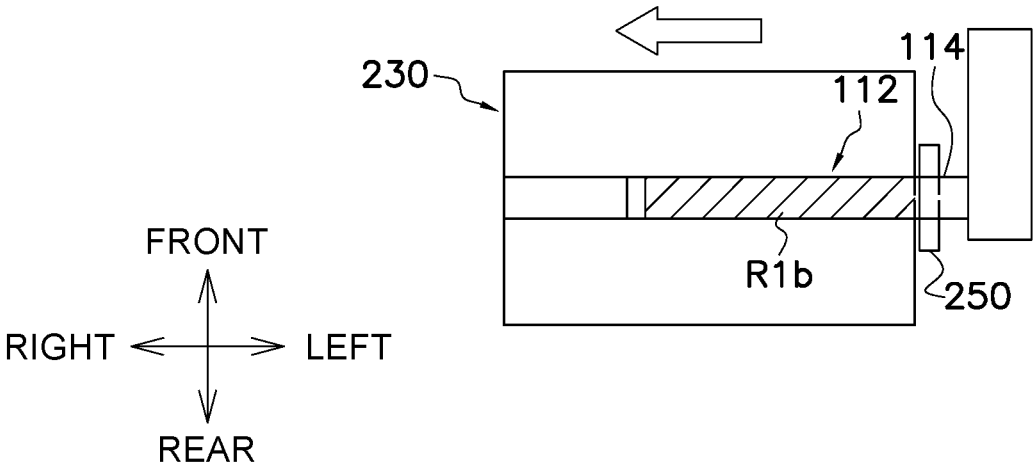
FIG. 10B is a schematic plan view of part of the film roll replacement device and illustrates the action of the film roll replacement device when the film roll is removed from the supporting shaft of the bag making and packaging machine.
Figure 10C:
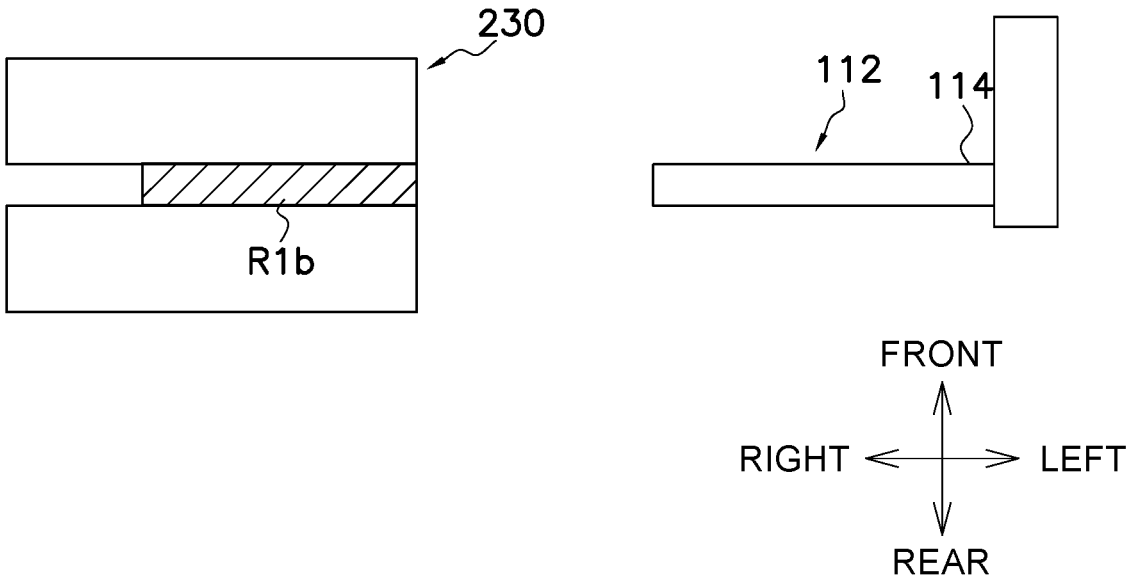
FIG. 10C is a schematic plan view of part of the film roll replacement device and illustrates the action of the film roll replacement device when the film roll is removed from the supporting shaft of the bag making and packaging machine.
Figure 10D:
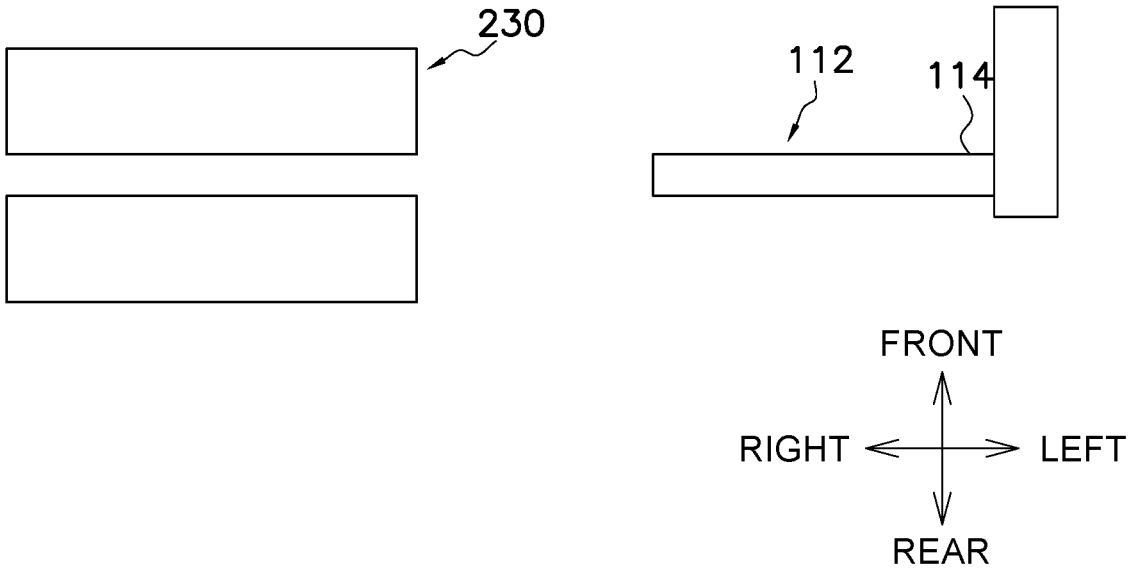
FIG. 10D is a schematic plan view of part of the film roll replacement device and illustrates the action of the film roll replacement device when the film roll is removed from the supporting shaft of the bag making and packaging machine.
Figure 11:
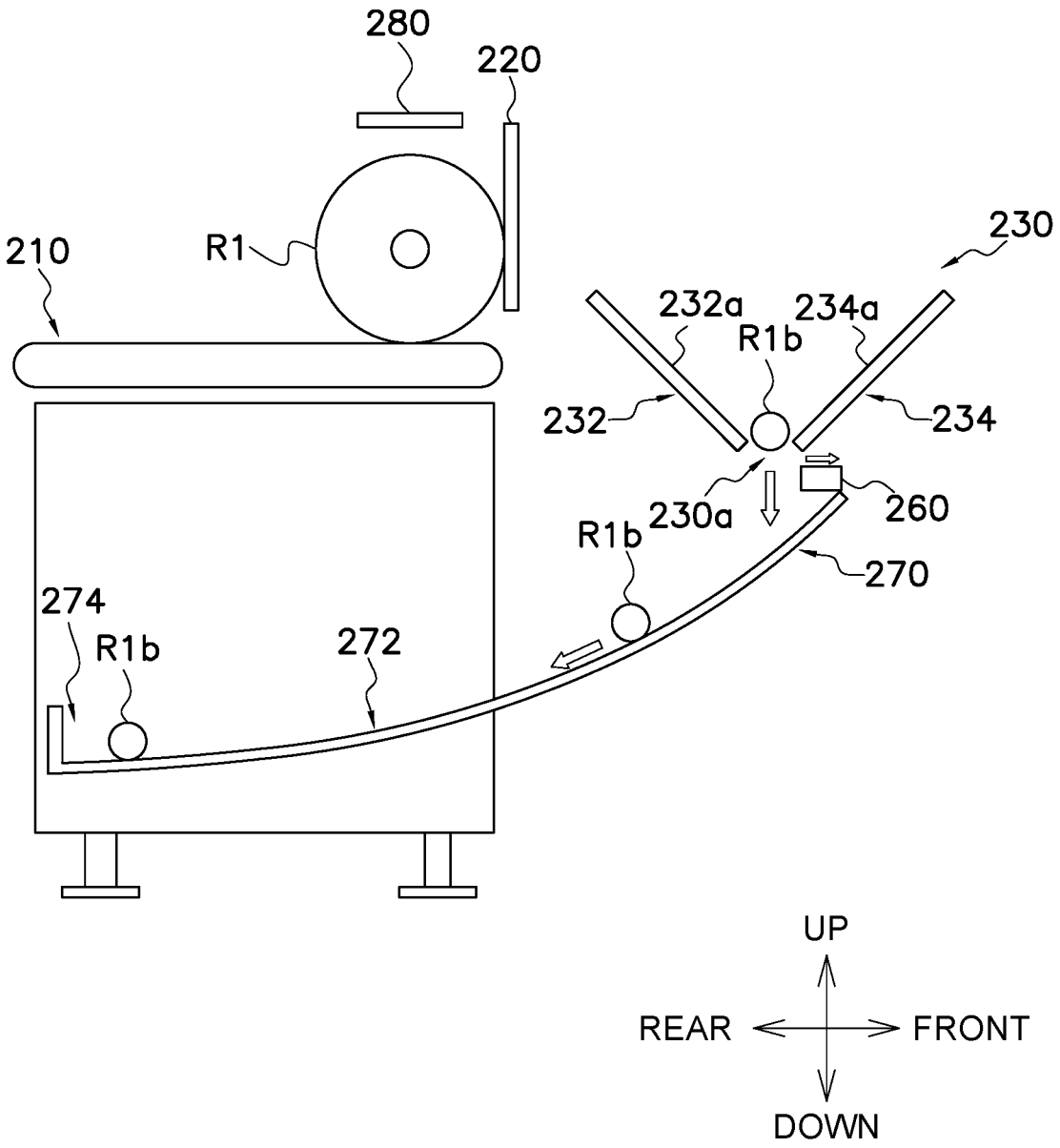
FIG. 11 is a schematic left-side view for illustrating the action of the film roll replacement device when a winding core of a depleted film roll is retrieved from a supporting shaft of the bag making and packaging machine.

Next, the controller 290 controls the action of the third driving unit 237 and moves the holding section 230 rightward from the position depicted in FIG. 10B to the position in FIG. 10C (the position where the holding section 230 is located at the point in time of FIG.

Through this process, the second film roll R1*b* is pushed and moved by the left-side pushing member 250 onto the holding section 230 as is depicted in FIG. 10C.

Upon moving the holding section 230 to the position depicted in FIG. 10C, the controller 290 controls the action of the left-side pushing-member-driving unit 252 and moves the left-side pushing member 250 to the previously described non-contact position.

Next, the controller 290 causes the stopper 260 to be moved to the open position by the stopper-driving unit 262. As a result, the second film roll R1*b* (the winding core WC of the second film roll Rib) falls from the gap 230*a* in the holding section 230. The detection result from the distance sensor 286 can be used to determine whether or not the second film roll R1*b* has fallen safely.

In this embodiment, it is assumed that the second film roll R1*b* is the depleted film roll R1, but it is acceptable if the controller 290 does not cause the stopper-driving unit 262 to drive the stopper when the second film roll R1*b* is a film roll R1 with film F still remaining (a film roll R1 of which use has been interrupted in the bag making and packaging machine 3). For example, in this case, the controller 290 may, using an output device (a display, a speaker, or the like) (not shown in the figure), issue a notification that the film roll R1 with remaining film F is present in the holding section 230. Based on this notification, a worker takes out the film roll R1 with remaining film present in the holding section 230.

When the controller 290 has caused the stopper 260 to be moved by the stopper-driving unit 262 to the open position, the second film roll Rib, after falling from the gap 230*a* in the holding section 230, slides down the inclined surface 272 of the winding-core-retrieving mechanism 270 to be retrieved in the retrieval area 274 located directly below the conveyor 210, as shown in FIG. 11.

(B) Mounting of First Film Roll on Supporting Shaft of Bag Making and Packaging Machine When removal of the second film roll R1*b* from the supporting shaft 114 of the bag making and packaging machine 3 is complete, the controller 290 supplies the first film roll R1*a* to the bag making and packaging machine 3 and mounts the first film roll R1*a* on the supporting shaft 114.

The movement of the first film roll R1*a* to the holding section 230 and the adjustment of the height position of the holding section 230 shall first be described with reference to FIGS. 12A to 12E. The mounting of the first film roll R1*a* onto the supporting shaft 114 of the bag making and packaging machine 3, performed by the film roll replacement device 200, shall then be described with reference to FIGS. 13A to 13E.

Figure 12A:
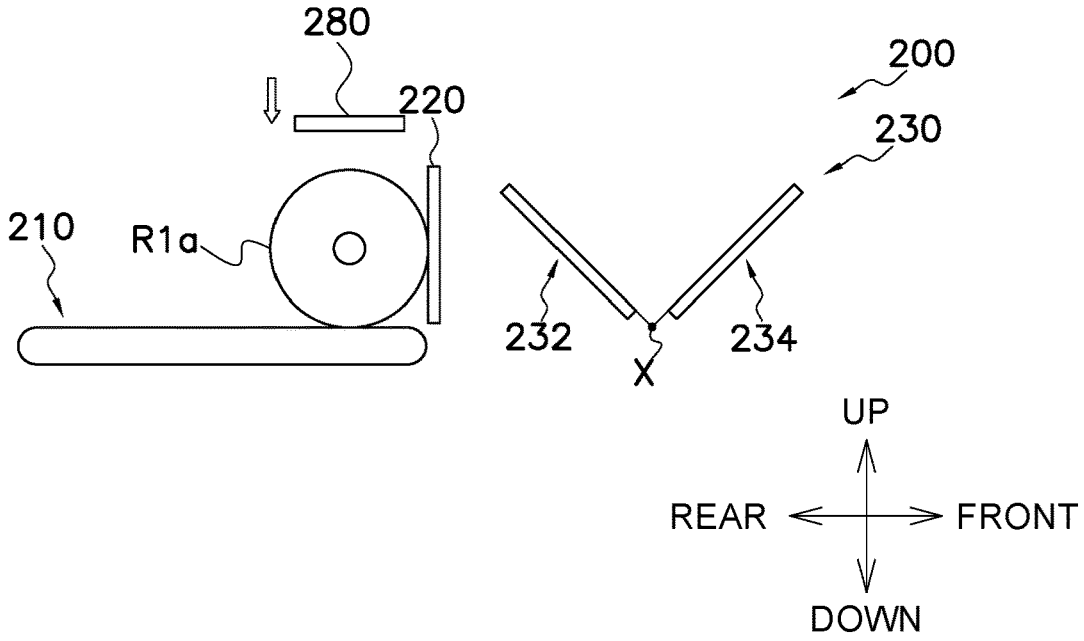
FIG. 12A is a schematic left-side view of part of the film roll replacement device and illustrates movement of a film roll to the holding section and adjustment of a height position of the holding section.

(B-1) Movement of First Film Roll to Holding Section and Adjustment of Height Position of Holding Section It is presumed in the description below that at the point in time depicted in FIG. 12A, a film roll R1 is not present on the holding section 230, and the holding section 230, which is in the second orientation previously described, is located in a position (initial position) adjacent to the front of the gate 220. In addition, at the point in time depicted in FIG. 12A, the gate 220 is in a position where the first film roll R1*a* is restricted from moving toward the holding section 230, and the first film roll R1*a* is being carried on the conveyor 210 in a position adjacent to the gate 220. The first member 280 is located in the above described first position where the first member 280 is apart from the first film roll R1*a* and above the first film roll R1*a*.

Figure 12B:
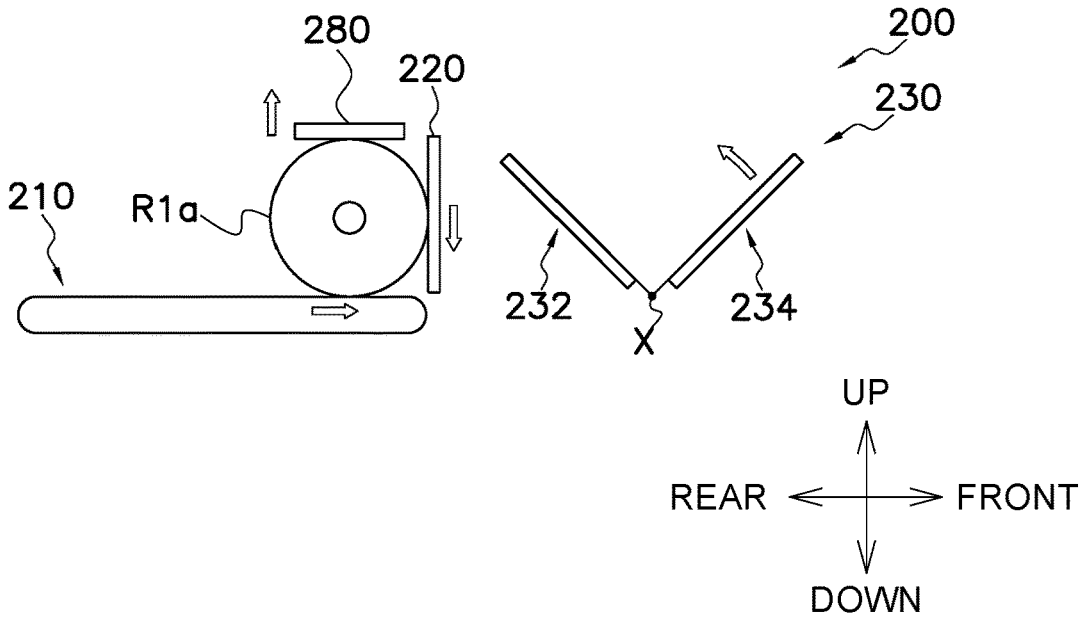
FIG. 12B is a schematic left-side view of part of the film roll replacement device and illustrates the movement of the film roll to the holding section and the adjustment of the height position of the holding section.

In this state, the controller 290 causes the first-member-driving unit 282 to move the first member 280 to a second position where contact is made with the outer peripheral surface (upper end) of the first film roll R1*a* carried on the conveyor 210 (see FIG. 12B).

When the first-member-driving unit 282 has moved the first member 280 from the first position to the second position, the controller 290 receives a signal, sent by the encoder 284, corresponding to an amount of rotational displacement of a motor (the first-member-driving unit 282). The controller 290 calculates the distance the first member 280 moves from the first position to the second position based on the signal of the encoder 284. Furthermore, the controller 290, serving as a first measuring unit, measures (calculates) the diameter of the first film roll R1*a* on the conveyor 210 based on the calculated movement distance of the first member 280. For example, a distance from the first position to a conveying surface (the surface on which the first film roll R1*a* is carried) of the conveyor 210 is stored in advance in a storage device of the controller 290. The controller 290 calculates the diameter of the first film roll R1*a* by subtracting the distance the first member 280 moves from the first position to the second position, from the distance from the first position to the conveying surface of the conveyor 210.

Next, the controller 290 causes the first-member-driving unit 282 to move the first member 280 to the first position where contact is not made with the outer peripheral surface of the first film roll R1*a*.

Next, the controller 290 controls the action of the first driving unit 235 to cause the holding section 230 to rotate and change the orientation of the holding section 230 from the second orientation to the first orientation. Particularly, in the present embodiment, when the holding section 230 is in the first orientation, the first holding surface 232*a* is horizontal. The controller 290 controls the action of the first driving unit 235 to cause the holding section 230 to rotate 45° counterclockwise in a left-side view, and changes the orientation of the holding section 230 from the second orientation to the first orientation (see FIG. 12C). For example, if the holding section 230 on the first holding surface 232*a* slightly inclined so as to lower from rear to front is defined as the holding section 230 in the first orientation, the angle at which the controller 290 causes the holding section 230 to rotate may be determined, as appropriate, to be a predetermined angle other than 45°.

Figure 12C:
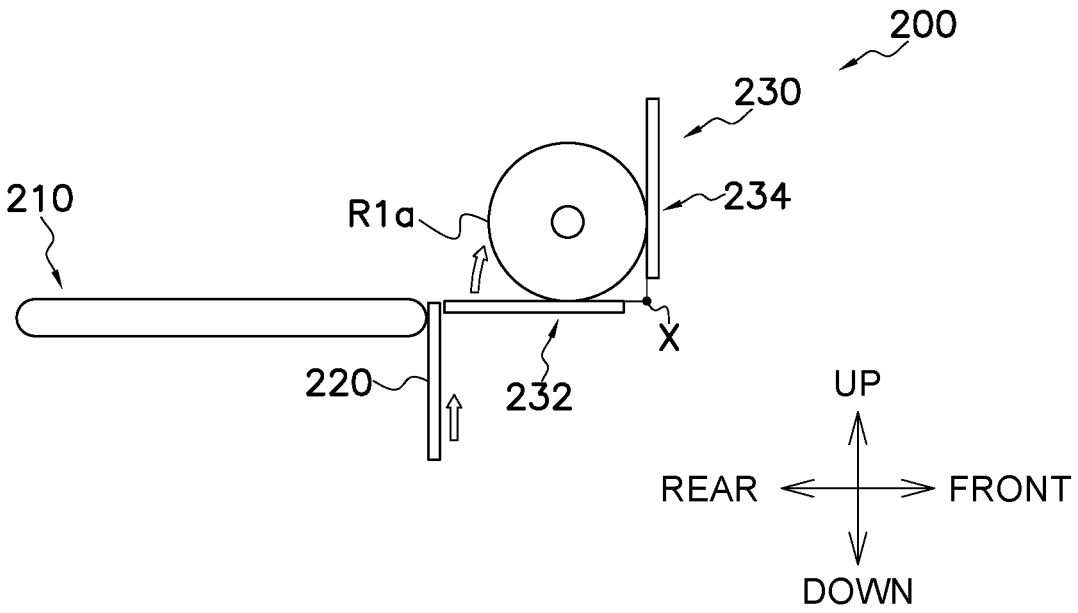
FIG. 12C is a schematic left-side view of part of the film roll replacement device and illustrates the movement of the film roll to the holding section and the adjustment of the height position of the holding section.

The controller 290 also controls the action of the gate-driving unit 222 to move the gate 220 to a position where the first film roll R1*a* is not restricted from moving toward the holding section 230 (see FIG. 12C). The controller 290 also controls the action of the conveyor 210 to move the first film roll R1*a* to the holding section 230 (see FIG. 12C).

The controller 290 then controls the action of the first driving unit 235 to cause the holding section 230 to rotate, and changes the orientation of the holding section 230 from the first orientation to the second orientation. Particularly, in the present embodiment, because the holding section 230 with the horizontal first holding surface 232*a* is the holding section 230 in the first orientation, the controller 290 controls the action of the first driving unit 235 to cause the holding section 230 to rotate 45° clockwise in a left-side view, and changes the orientation of the holding section 230 from the first orientation to the second orientation (see FIG. 12C). For example, if the holding section 230 on the first holding surface 232*a* slightly inclined so as to lower from rear to front is defined as the holding section 230 in the first orientation, the angle at which the controller 290 causes the holding section 230 to rotate may be determined, as appropriate, to be a predetermined angle other than 45°.

Figure 12D:
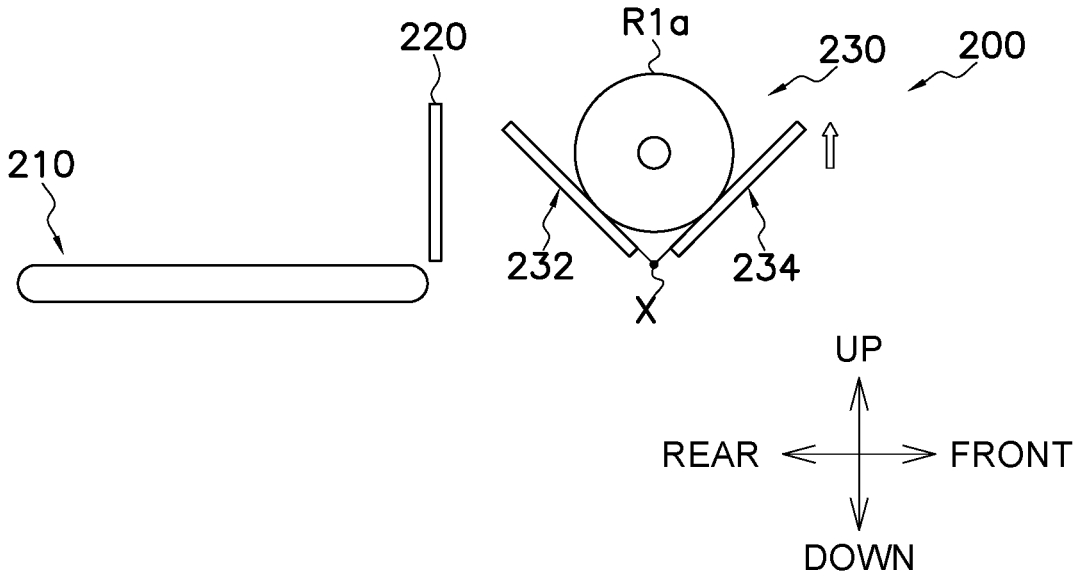
FIG. 12D is a schematic left-side view of part of the film roll replacement device and illustrates the movement of the film roll to the holding section and the adjustment of the height position of the holding section.

The controller 290 also controls the action of the gate-driving unit 222 to move the gate 220 to a position where the first film roll R1*a* is restricted from moving toward the holding section 230 (see FIG. 12D). The controller 290 also stops the action of the conveyor 210.

Next, based on the measured diameter of the first film roll R1*a*, the controller 290 controls the action of the second driving unit 236 to move the holding section 230 to a position where the height position of the center of the first film roll R1*a* held in the holding section 230 is aligned with the height of the center of the supporting shaft 114 disposed in the film roll replacement position.

Figure 14:
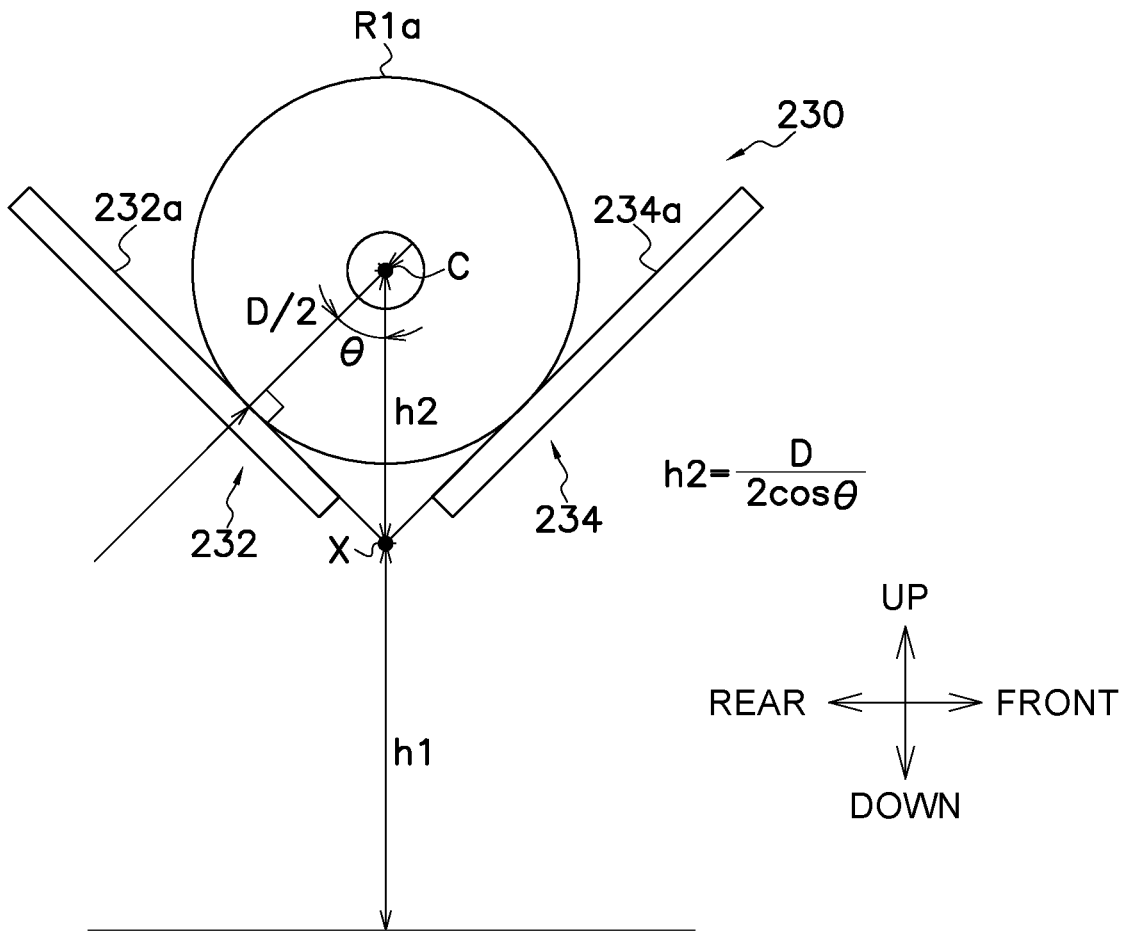
FIG. 14 is an enlarged view of the holding section of the film roll replacement device, and is a drawing for illustrating a method of measuring the height position up to the center of the first film roll.

For example, specifically, the controller 290 changes the height position of the holding section 230 in the following manner. The description shall be made with reference to FIG. 14. FIG. 14 is an enlarged view of the holding section 230 of the film roll replacement device 200, and is a drawing for describing a method of measuring the height position to the center of the first film roll R1*a*.

It is presumed in the description below that the storage device of the controller 290 has stored therein information on the height position of the center of the supporting shaft 114 disposed in the film roll replacement position (e.g., a height H1 from a floor surface to the center of the supporting shaft 114). It is also presumed in the description below that the controller 290 ascertains, for example, a height position that is the current location of the intersection point X between a straight line imagined as an extension of the first holding surface 232*a* and a straight line imagined as an extension of the second holding surface 234*a* in a left-side view (e.g., a height h1 from the floor surface to the intersection point X).

Under such conditions, the controller 290 calculates in the following manner the height position of the center of the first film roll R1*a* currently held by the holding section 230. Because the height h1 from the floor surface to the intersection point X is known at present, the height from the floor surface to the center (represented by symbol C) of the first film roll R1*a* can be determined when the value of h2 is determined in FIG. 14. The controller 290 has calculated the diameter D of the first film roll R1*a* as previously described. In addition, in a left-side view, an angle θ formed between a straight line connecting the intersection point X and the center C and a line perpendicular to the first holding surface 232*a* is determined according to the design of the holding section 230 and is therefore known. Therefore, using a trigonometric function, h2 can be calculated by the formula $D/2 \cos \theta$. The controller 290 calculates the height position of the center of the first film roll R1*a* currently held by the holding section 230 by adding the value h1 and the value h2 together. When the height position of the center of the first film roll R1*a* currently held by the holding section 230 is calculated and the holding section 230 is moved upward by a distance of $\Delta h = H1 - (h1 + h2)$, the height position of the center of the first film roll R1*a* held by the holding section 230 will be aligned with the height position of the center of the supporting shaft 114 disposed in the film roll replacement position.

Figure 12E:
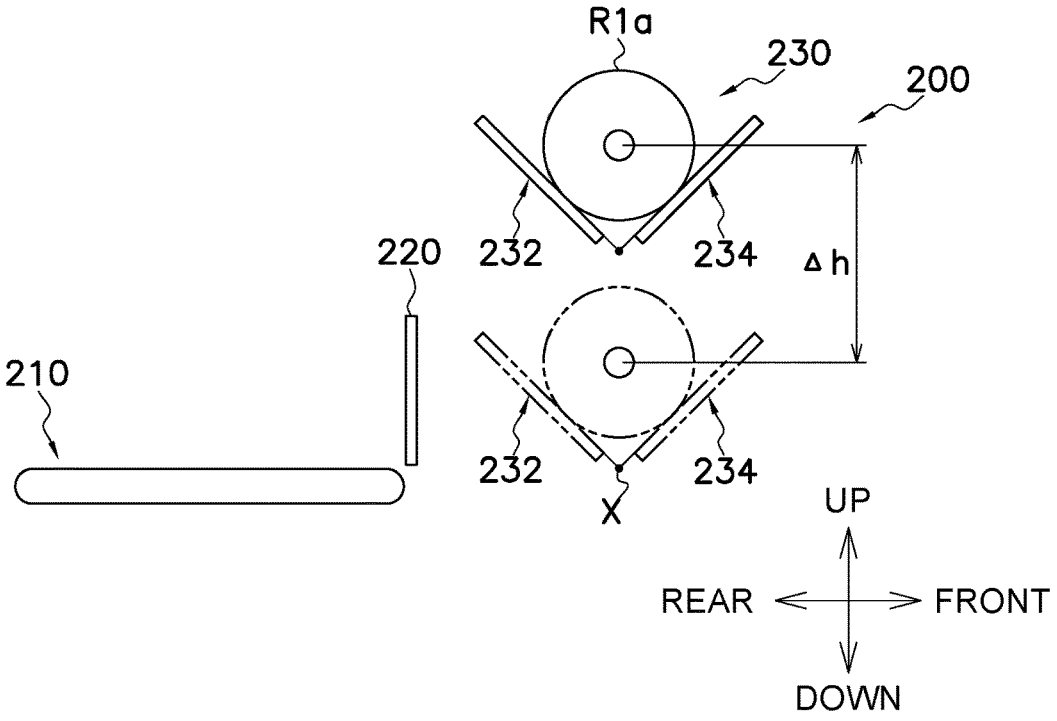
FIG. 12E is a schematic left-side view of part of the film roll replacement device and illustrates the movement of the film roll to the holding section and the adjustment of the height position of the holding section.

The controller 290 then controls the action of the second driving unit 236 to move the holding section 230 upward by a distance of Ah from the position drawn in double-dash lines to the position drawn in solid lines, as in FIG. 12E. As a result, the height position of the center of the first film roll R1*a* held by the holding section 230 is aligned with the height position of the center of the supporting shaft 114 disposed in the film roll replacement position. If the value of Ah is negative, the holding section 230 is caused to move downward.

Due to the structure of the holding section 230, the center C of the first film roll R1 held in the holding section 230 is disposed in the same position as the intersection point X previously described in the front-rear direction. In other words, in a left-side view, the center of the first film roll R1 held in the holding section 230 is disposed on a straight line extending in the vertical direction through the intersection point X. Therefore, if the film roll replacement device 200 is designed such that the front-rear-directional position of the intersection point X does not change, there is no need, in the front-rear direction, to adjust the position of the center of the first film roll R1*a* held in the holding section 230 and the position of the center of the supporting shaft 114 disposed in the film roll replacement position.

The film roll replacement device 200 preferably has, for example, both an electric cylinder and an air cylinder as the second driving unit 236. The reason therefor shall now be described.

Even, for example, using only an electric cylinder as the second driving unit 236, the film roll replacement device 200 can move the holding section 230 to a position where the height position of the center of the first film roll R1*a* held by the holding section 230 is aligned with the height of the center of the supporting shaft 114 disposed in the film roll replacement position. However, since the first film roll R1*a* is a heavy object, a large electric cylinder will be needed if the holding section 230 carrying the first film roll R1*a* is to be moved by an electric cylinder alone. Therefore, the film roll replacement device 200 preferably uses an air cylinder in addition to an electric cylinder.

As a specific control, for example, when moving the holding section 230, the controller 290 controls an electro-pneumatic regulator (not shown in the figure) to gradually increase an internal pressure of the air cylinder. When a slight movement of the holding section 230 (a movement of the first film roll R1*a* held in the holding section 230) is sensed using the distance sensor 286 or the like, the controller 290 controls the electric cylinder to bring the height position of the center of the first film roll R1*a* held in the holding section 230 into alignment with the height of the center of the supporting shaft 114 disposed in the film roll replacement position while pressure generated by the electro-pneumatic regulator (not shown in the figure) is kept constant.

(B-2) Mounting of First Film Roll onto Supporting Shaft of Bag Making and Packaging Machine The following is a description of how the first film roll R1*a* is mounted onto the supporting shaft 114 by the film roll replacement device 200 after the height position of the center of the first film roll R1*a* held by the holding section 230 and the height position of the center of the supporting shaft 114 disposed in the film roll replacement position have come into alignment.

Figure 13A:
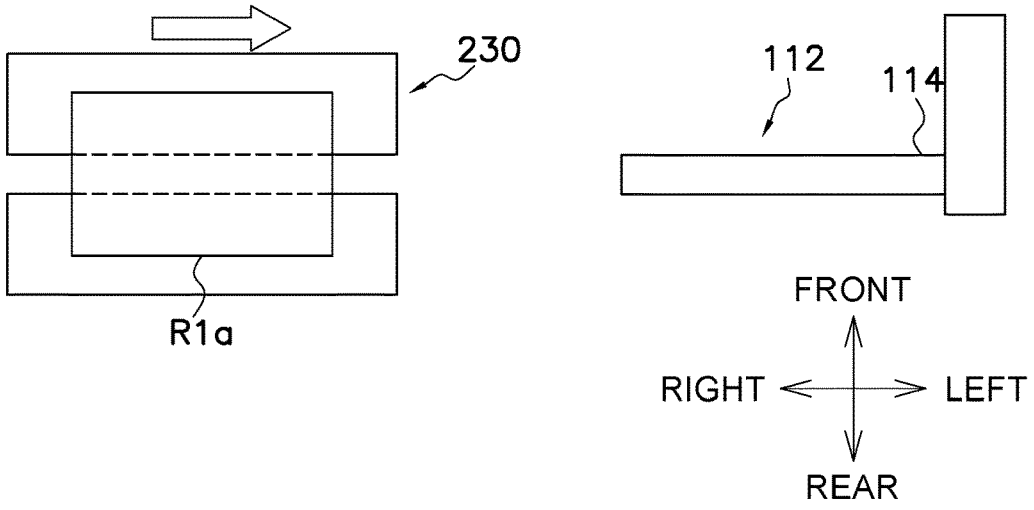
FIG. 13A is a schematic plan view of part of the film roll replacement device and illustrates mounting of a film roll on a supporting shaft of the bag making and packaging machine by the film roll replacement device.

It is presumed in the description below that at the point in time depicted in FIG. 13A, as seen in plan view, the holding section 230 is disposed in front of the gate 220 in an adjacent position (initial position), and the right-side pushing member 240 and the left-side pushing member 250 are disposed in the non-contact positions previously described.

First, the controller 290 controls the action of the right-side pushing-member-driving unit 242 to move the right-side pushing member 240 to a contact position where said member can be in contact with the right end surface of the first film roll R1*a*, and particularly a contact position where said member can at least be in contact with the winding core WC of the first film roll R1*a*.

Figure 13B:
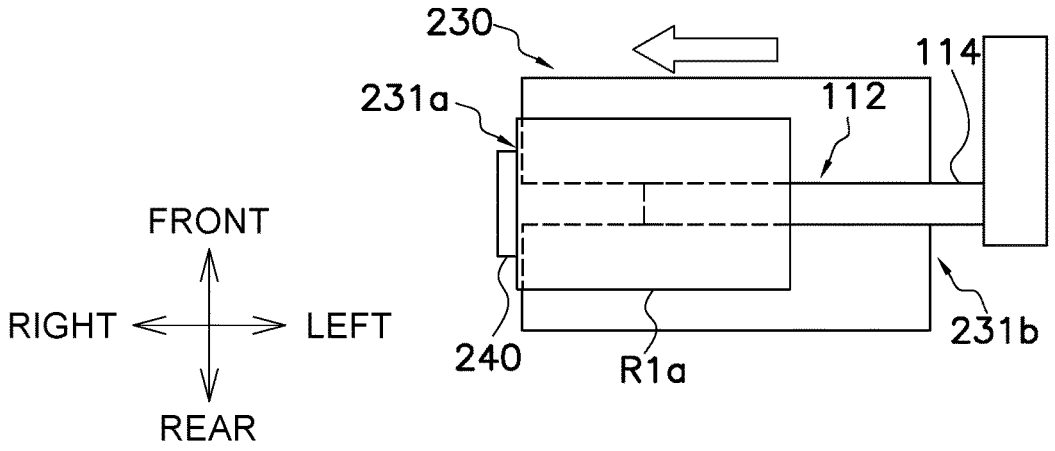
FIG. 13B is a schematic plan view of part of the film roll replacement device and illustrates the mounting of the film roll on the supporting shaft of the bag making and packaging machine by the film roll replacement device.
Figure 13C:
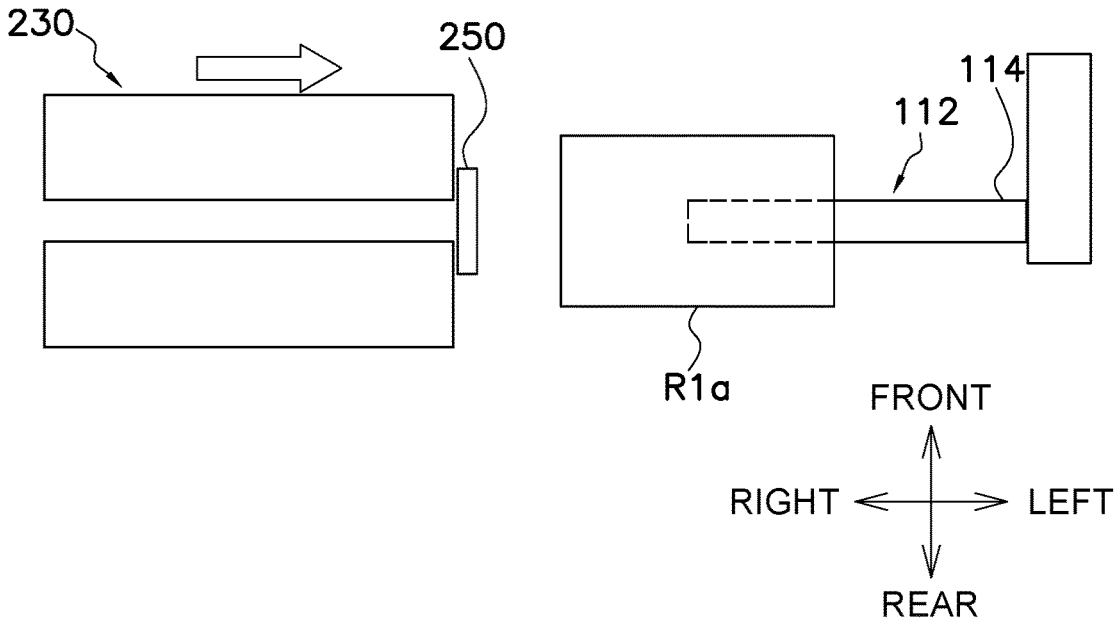
FIG. 13C is a schematic plan view of part of the film roll replacement device and illustrates the mounting of the film roll on the supporting shaft of the bag making and packaging machine by the film roll replacement device.

Next, the controller 290 controls the action of the third driving unit 237 to move the holding section 230 from the initial position leftward toward the supporting shaft 114 disposed in the film roll replacement position in FIG. 13B on the left side, and transfer the first film roll R1*a* held in the holding section 230 to the supporting part 112. This step shall now be described in detail.

When the controller 290 controls the action of the third driving unit 237 to move the holding section 230 leftward, the supporting shaft 114 is inserted into the hollow part of the winding core WC of the first film roll R1*a* held by the holding section 230, and the first film roll R1*a* of the holding section 230 is transferred to the supporting shaft 114. Particularly, when there is little difference between the outer diameter of the supporting shaft 114 and a diameter of the hollow part of the winding core WC, there are cases in which even if the holding section 230 is moved to the left, the first film roll R1*a* will not move to the left beyond a certain point due to friction between an inner surface of the hollow part of the winding core WC and an outer surface of the supporting shaft 114. However, because the right-side pushing member 240 is disposed adjacent to the first end portion 231*a* (right end portion) of the holding section 230, when the first film roll R1*a* comes to be disposed to the right of the first end portion 231*a* of the holding section 230, a right end surface of the first film roll R1*a* is pushed by the right-side pushing member 240 driven by the third driving unit 237, and the supporting shaft 114 is inserted deeper into the hollow part of the winding core WC of the first film roll R1*a* (see FIG. 13B). In other words, at this time, the controller 290 controls the action of the third driving unit 237 to cause the end surface of the first film roll R1*a* held by the holding section 230 to be pushed by the right-side pushing member 240 and the first film roll R1*a* moves to the supporting shaft 114.

When the region over which the holding section 230 can move left is sufficiently wide, the supporting shaft 114 can be sufficiently inserted into the hollow part of the winding core WC of the first film roll R1*a* by the right-side pushing member 240 alone, and the first film roll R1*a* can be set at a predetermined position on the supporting shaft 114.

Such a design makes it necessary to ensure sufficient area for the holding section 230 to move, presenting a possibility that the floor area required for installing the bag making and packaging machine 3 and the film roll replacement device 200 will increase. Therefore, the film roll replacement device 200 is preferably designed as follows.

When the second end portion 231*b* of the holding section 230 reaches the vicinity of a supporting end of the supporting shaft 114, the controller 290 controls the action of the second driving unit 236 to move the holding section 230 slightly downward, and controls the action of the third driving unit 237 to move the holding section 230 rightward to the initial position.

The controller 290 then controls the action of the right-side pushing-member-driving unit 242 to move the right-side pushing member 240 to the non-contact position. The controller 290 also controls the action of the left-side pushing-member-driving unit 252 to move the left-side pushing member 250 to a contact position where said member can be in contact with the right end surface of the first film roll R1*a* that has been moved to the supporting shaft 114, and particularly a contact position where said member can at least be in contact with the right end surface of the winding core WC of the first film roll R1*a*.

Figure 13D:
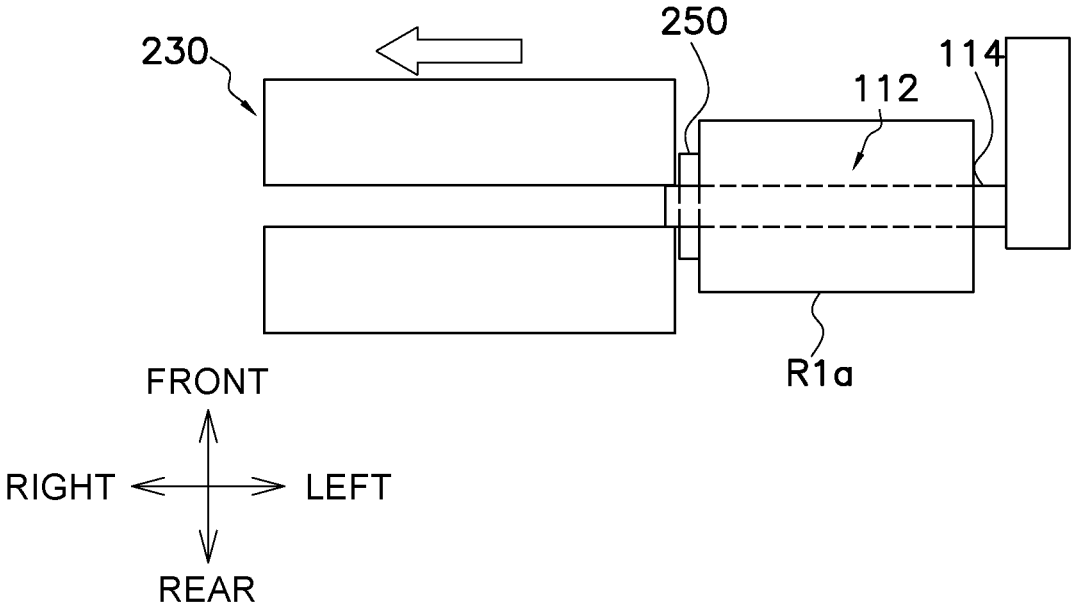
FIG. 13D is a schematic plan view of part of the film roll replacement device and illustrates the mounting of the film roll on the supporting shaft of the bag making and packaging machine by the film roll replacement device.
Figure 13E:
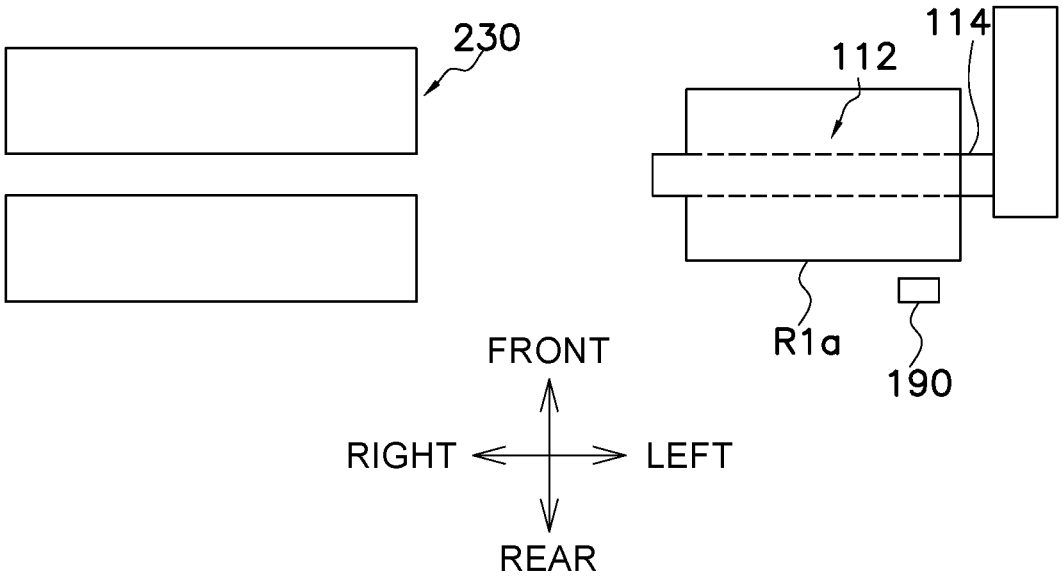
FIG. 13E is a schematic plan view of part of the film roll replacement device and illustrates the mounting of the film roll on the supporting shaft of the bag making and packaging machine by the film roll replacement device.

Next, the controller 290 controls the action of the third driving unit 237 to move the holding section 230 and the left-side pushing member 250 to the left to a predetermined position (the position depicted in FIG. 13D). This predetermined position is determined in advance according to factors such as the dimensions of the film rolls R1 to be used. As a result of the controller 290 controlling the actions of the film roll replacement device 200 in this manner, the first film roll R1*a* is positioned by the left-side pushing member 250 to be disposed in an appropriate position on the supporting shaft 114.

In the state depicted in FIG. 13D, the left-side pushing member 250 and the supporting shaft 114 are disposed in overlapping positions in the left-right direction. However, because the recess 250*a* is formed as previously described in the left-side pushing member 250, the supporting shaft 114 and the left-side pushing member 250 do not come into contact even if the left-side pushing member 250 and the supporting shaft 114 are disposed in overlapping positions in the left-right direction.

The controller 290 then issues a notification to the packaging machine controller 4 that the supply of the first film roll R1*a* to the supporting shaft 114 has ended. The controller 290 also controls the action of the third driving unit 237 to move the holding section 230 to the initial position (the same position as that depicted in FIG. 13A) at a predetermined timing (see FIG. 13E). The controller 290 controls the action of the left-side pushing-member-driving unit 252 to move the left-side pushing member 250 to the non-contact position described above (see FIG. 13E). Furthermore, the controller 290 controls the action of the second driving unit 236 to move the holding section 230 to the height position depicted in FIG. 12A at a predetermined timing.

If the timing at which the controller 290 moves the holding section 230 to the initial position and moves the left-side pushing member 250 to the non-contact position is delayed until the timing at which the packaging machine controller 4 controls the action of the fixing mechanism of the supporting shaft 114 to fix the first film roll R1*a* and the supporting shaft 114 together, the left-side pushing member 250 can also be given the function of restricting the position of the first film roll R1*a*.

Though this is not a detail pertaining to the actions of the film roll replacement device 200, at the point in time when the supply of the first film roll R1*a* to the supporting shaft 114 has ended and the first film roll R1*a* has been fixed to the supporting shaft 114, the packaging machine controller 4 preferably causes the first film roll R1*a* to rotate via the support-shaft-driving unit 116 and reads a bar code or matrix-type two-dimensional code (not shown in the figure) on the film roll R1 via the scanner 190 disposed near the supporting shaft 114 disposed in the film roll replacement position. The packaging machine controller 4 then preferably confirms whether or not the type of film roll R1 specified by the bar code or matrix-type two-dimensional code read by the scanner 190 matches the type of film roll R1 that should be mounted on the supporting shaft 114. This feature would make it possible to check if the correct film roll R1 has been supplied to the bag making and packaging machine 3 even if the film roll R1 is automatically supplied to the bag making and packaging machine 3.

(3) Characteristics (3-1)

The film roll replacement device 200 supplies the film roll R1, in which film F is wound around a hollow winding core WC, to a bag making and packaging machine 3 that has a supporting part 112 serving as a film-roll-supporting part to support the film roll R1 and that uses the film F to manufacture bags B containing articles P. The film roll replacement device 200 includes a holding section 230, a third driving unit 237 serving as an example of the holding-section-driving unit in the claims, and a controller 290 serving as an example of the control unit in the claims. The holding section 230 is located adjacent to the bag making and packaging machine 3, and the holding section 230 holds the film roll R1 supplied to the bag making and packaging machine 3. The third driving unit 237 moves the holding section 230. The controller 290 controls an action of the third driving unit 237 to move the holding section 230 leftward as an example of the first direction in the claims toward the supporting part 112 of the bag making and packaging machine 3, and transfers the film roll R1 held by the holding section 230 to the supporting part 112.

The film roll replacement device 200 automatically supplies the film roll R1 to the bag making and packaging machine 3, and the burden on a worker with regard to the work of supplying the film roll R1 to the bag making and packaging machine 3 can therefore be reduced.

(3-2)

The film roll replacement device 200 comprises a right-side pushing member 240 serving as an example of the first pushing member in the claims, and the third driving unit 237 serving as an example of the first-pushing-member-driving unit in the claims, which moves the right-side pushing member 240. The controller 290 controls the action of the third driving unit 237 to move the film roll R1 to the supporting part 112 by making the right-side pushing member 240 push an end surface of the film roll R1 held by the holding section 230. In the film roll replacement device 200, because the right-side pushing member 240 pushes and moves the film roll R1, the film roll R1 can be accurately transferred to a predetermined position on the supporting part 112.

(3-3)

In the film roll replacement device 200, the right-side pushing member 240 pushes at least an end surface of the winding core WC in the end surface of the film roll R1.

In the film roll replacement device 200, because the right-side pushing member 240 pushes the winding core WC, deformation of the film roll R1 (deformation in which part of the film is displaced from the winding core WC in an axial direction of the winding core WC) is suppressed more readily than if the right-side pushing member 240 were to push only a portion of the film F.

(3-4)

The supporting part 112 of the bag making and packaging machine 3 has a supporting shaft 114 that is inserted into the hollow winding core WC and that supports the film roll R1. A recess 240*a* conforming to an outer shape of the supporting shaft 114 is formed in the right-side pushing member 240.

In the film roll replacement device 200, because the recess 240*a* conforming to the outer shape of the supporting shaft 114 is formed in the right-side pushing member 240, a comparatively wide portion of the end surface of the winding core WC can be pushed near the supporting shaft 114 by the right-side pushing member 240 without bringing the right-side pushing member 240 into contact with the supporting shaft 114, and the film roll R1 can thus be pushed to a far position onto the supporting shaft 114.

(3-5)

In the film roll replacement device 200, the third driving unit 237 also functions as a first-pushing-member-driving unit to move the right-side pushing member 240. The third driving unit 237 moves the holding section 230 and the right-side pushing member 240 leftward together.

In the film roll replacement device 200, because the third driving unit 237 to drive the holding section 230 also functions as a first-pushing-member-driving unit to drive the right-side pushing member 240, the number of instruments constituting the film roll replacement device 200 can be reduced.

(3-6)

The film roll replacement device 200 includes a left-side pushing member 250 serving as an example of the second pushing member in the claims, and a left-side pushing-member-driving unit 252 serving as an example of the second-pushing-member-driving unit in the claims, which moves the left-side pushing member 250 in an up-down direction. The holding section 230 has a first end portion 231*a* located on a side farther from the supporting part 112 in a left-right direction, and a second end portion 231*b* located on a side nearer to the supporting part 112, on the side opposite to the first end portion 231*a*. The right-side pushing member 240 is located adjacent to the first end portion 231*a*. The left-side pushing member 250 is located adjacent to the second end portion 231*b*. The controller 290, after making the right-side pushing member 240 push the end surface of the film roll R1 held by the holding section 230 and moving the film roll R1 to the supporting part 112, controls the action of the left-side pushing-member-driving unit 252 to move the left-side pushing member 250 to a height position where the left-side pushing member 250 can contact with the end surface of the film roll R1 moved to the supporting part 112, and further controls the action of the third driving unit 237 to push the end surface of the film roll R1 moved to the supporting part 112 by the left-side pushing member 250 and to move the film roll to be moved R1 leftward.

In the film roll replacement device 200, a region over which the holding section 230 can move in a direction along the left-right direction can be suppressed by using the right-side pushing member 240 and the left-side pushing member 250, and a width of the film roll replacement device 200 in the left-right direction can therefore be suppressed.

(3-7)

The film roll replacement device 200 includes a left-side pushing member 250 serving as an example of the third pushing member in the claims, and a third driving unit 237 serving as an example of the third-pushing-member-driving unit in the claims, which moves the left-side pushing member 250 rightward as an example of the second direction in the claims, which is opposite to the first direction (leftward). The controller 290 further controls the action of the third driving unit 237 to move the film roll R1 to the holding section 230 by making the left-side pushing member 250 push the end surface of the film roll R1 held by the supporting part 112.

In the film roll replacement device 200, a depleted film roll R1 (a film roll R1 with no film F left or mostly no film F left) or a film roll R1 that has ceased to be used without being depleted (a film roll R1 with film F left) can be automatically removed using the left-side pushing member 250.

(3-8)

The supporting part 112 of the bag making and packaging machine 3 has a supporting shaft 114 that is inserted into the hollow winding core WC and that supports the film roll R1. A recess 250*a* conforming to an outer shape of the supporting shaft 114 is formed in the left-side pushing member 250.

In the film roll replacement device 200, because the recess 250*a* conforming to the outer shape of the supporting shaft 114 is formed in the left-side pushing member 250, a comparatively wide portion of the end surface of the winding core WC is pushed near the supporting shaft 114 and the winding core WC can be removed from the supporting shaft without bringing the left-side pushing member 250 into contact with the supporting shaft 114, even when there is substantially no film F remaining on the film roll R1.

(3-9)

The film roll replacement device 200 includes a second driving unit 236 serving as an example of the up-down direction driving unit in the claims and a distance sensor 286 serving as an example of the measuring unit in the claims. The second driving unit 236 moves the holding section 230 in the up-down direction. The distance sensor 286 measures a distance in the up-down direction between the holding section 230 and a surface of the film roll R1 supported by the supporting part 112. The controller 290 further controls the action of the second driving unit 236 to adjust the height position of the holding section 230 based on the distance measured by the distance sensor 286 before the film roll R1 supported by the supporting part 112 is moved to the holding section 230.

In the film roll replacement device 200, it is possible to suppress situations such as those in which the film roll R1 supported by the supporting part 112 falling onto the holding section 230 from a high position and the holding section 230 being damaged.

(3-10)

In the film roll replacement device 200, the third driving unit 237 also functions as a third-pushing-member-driving unit to move the left-side pushing member 250 rightward. The third driving unit 237 moves the holding section 230 and the left-side pushing member 250 together rightward when moving the film roll R1 to the holding section 230 by pushing the end surface of the film roll R1 supported by the supporting part 112 with the left-side pushing member 250.

In the film roll replacement device 200, because the third driving unit 237 to drive the holding section 230 also functions as the driving unit to drive the left-side pushing member 250, the number of instruments constituting the film roll replacement device 200 can therefore be reduced.

(3-11)

The film roll replacement device 200 includes a winding-core-retrieving mechanism 270 serving as an example of the retrieval section in the claims, where the winding core WC of the depleted film roll R1 is retrieved. The holding section 230 has a gap 230*a* formed therein through which the winding core WC of the depleted film roll R1 moved from the supporting part 112 falls to the winding-core-retrieving mechanism 270.

In the film roll replacement device 200, the depleted film roll R1, having been automatically removed from the supporting part 112, can be withdrawn from the holding section 230.

(3-12)

In the film roll replacement device 200, a stopper 260 is placed in the gap 230*a* of the holding section 230. The stopper 260 moves between a first position where the winding core WC is prevented from falling into the winding-core-retrieving mechanism 270 and a second position where the winding core WC is allowed to fall into the winding-core-retrieving mechanism 270.

In the film roll replacement device 200, it is possible to suppress, inter alia, a film roll R1 (winding core WC) from falling from the gap 230*a* at an unintended timing, or a film roll R1 not to be retrieved in the winding-core-retrieving mechanism 270 from falling into the winding-core-retrieving mechanism 270.

(3-13)

A film roll supply method is a method of supplying a film roll R1, in which a film F is wound around a hollow winding core WC, using a film roll replacement device 200 to a bag making and packaging machine 3 that has a supporting part 112 to support the film roll R1 and that manufactures bags B containing articles P using the film F. The film roll replacement device 200 has a holding section 230 and a third driving unit 237 serving as an example of the holding-section-driving unit in the claims. The holding section 230 is located adjacent to the bag making and packaging machine 3, and the holding section 230 holds the film roll R1 supplied to the bag making and packaging machine 3. The third driving unit 237 moves the holding section 230. The film roll supply method includes a step in which the third driving unit 237 moves the holding section 230 leftward (in a first direction) toward the supporting part 112 of the bag making and packaging machine 3 to transfer the film roll R1 held by the holding section 230 to the supporting part 112.

In this film roll supply method, the film roll R1 is automatically supplied to the bag making and packaging machine 3, and the burden on a worker with regard to the work of supplying the film roll R1 to the bag making and packaging machine 3 can therefore be reduced.

(3-14)

A film roll removal method is a method of removing a film roll R1, in which a film F is wound around a hollow winding core WC, using a film roll replacement device 200 from a bag making and packaging machine 3 that has a supporting part 112 to support the film roll R1 and that manufactures bags B containing articles P using the film F. The film roll replacement device 200 has a holding section 230 located adjacent to the bag making and packaging machine 3, a third driving unit 237 that moves the holding section 230, a left-side pushing member 250 serving as an example of the pushing member in the claims, a third driving unit 237 serving as an example of the pushing-member-driving unit in the claims, which moves the left-side pushing member 250, and a distance sensor 286 serving as an example of the measuring unit in the claims to measure a distance between the holding section 230 and a surface of the film roll R1 supported by the supporting part 112. The film roll removal method includes a step in which the third driving unit 237 moves the holding section 230 to be below the supporting part 112. The film roll removal method also includes a step in which the distance sensor 286 measures the distance between the holding section 230 and the surface of the film roll R1 supported by the supporting part 112. The film roll removal method also includes a step in which the third driving unit 237 adjusts a height of the holding section 230 based on the distance measured by the distance sensor 286. The film roll removal method also includes a step in which the third driving unit 237 drives the left-side pushing member 250 to bring the left-side pushing member 250 into contact with an end surface of the film roll R1 supported by the supporting part 112. The film roll removal method also includes a step in which the third driving unit 237 drives the left-side pushing member 250 to push the end surface of the film roll R1 rightward and the third driving unit 237 moves the holding section 230 rightward from below the supporting part 112, so as to move the film roll R1 supported by the supporting part 112 to the holding section 230.

In this film roll removal method, a depleted film roll R1 (a film roll R1 with no film F left or with mostly no film F left) or a film roll R1 that has ceased to be used without being depleted (a film roll R1 with film F left) can be automatically removed from the bag making and packaging machine 3.

(4) Modifications

Modifications of the present embodiment are presented below. The modifications may be combined as appropriate provided no contradictions occur therebetween.

(4-1) Modification A

In the above embodiment, the controller 290 measures the diameter D of the first film roll R1*a* based on the signal output by the encoder 284 attached to a motor serving as the first-member-driving unit 282.

However, a measurement method based on the signal output by the encoder 284 is not provided by way of limitation to the method of measuring the diameter D of the first film roll R1*a*.

Figure 15:
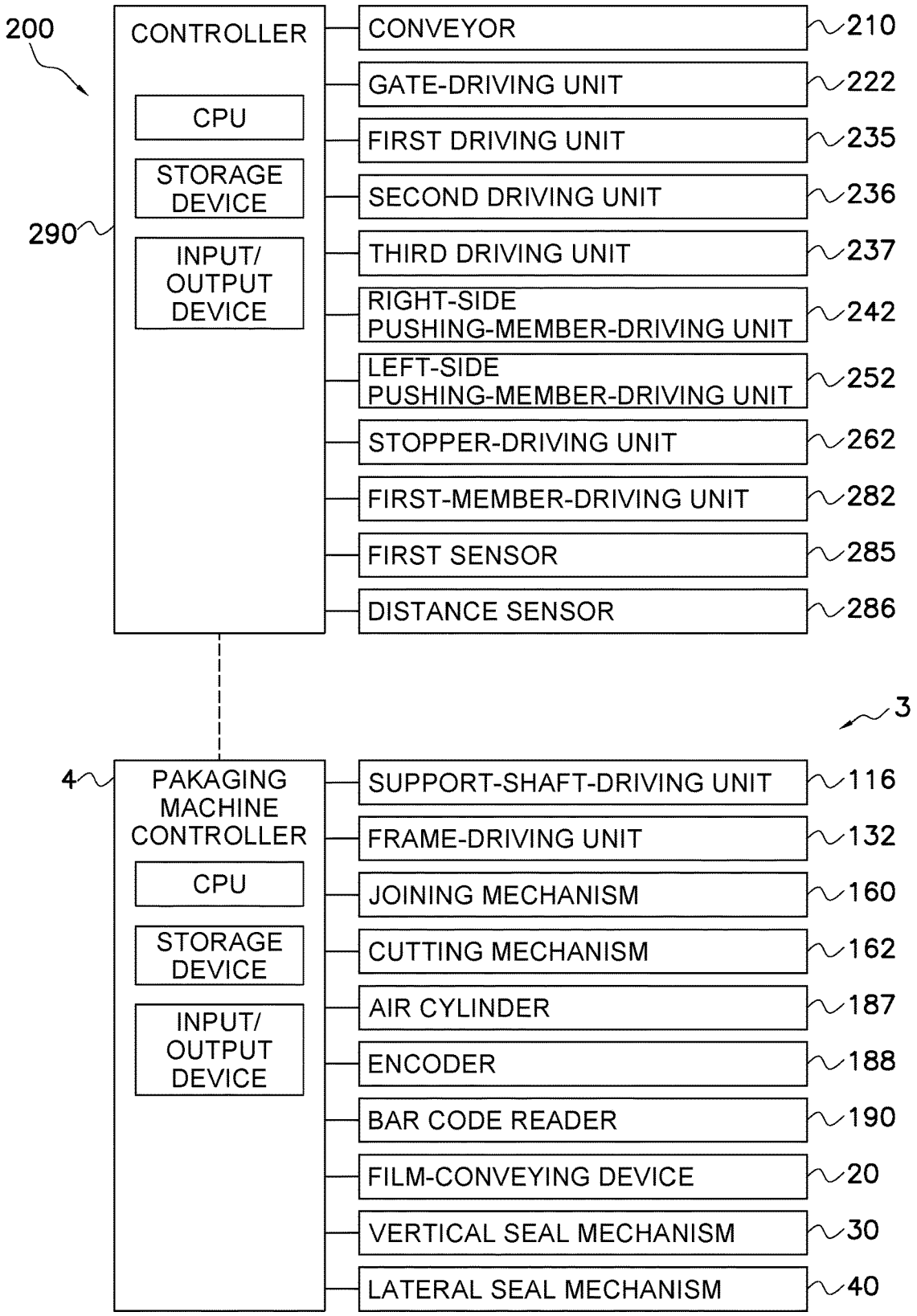
FIG. 15 is a control block diagram of the film roll replacement device of Modification A.

For example, the film roll replacement device 200 may have a first sensor 285 instead of the encoder 284 as shown in FIG. 15. In addition, the first-member-driving unit 282 may be an air cylinder or another driving mechanism other than a motor in this case. The first sensor 285 is located, for example, directly below the first member 280 or directly above the first member 280. The first sensor 285 is a laser distance sensor that contactlessly measures a first distance (a distance in the up-down direction in this modification) from a first reference position (e.g., a position where the first sensor 285 is installed) to the first member 280 in contact with the outer peripheral surface of the first film roll R1*a*.

The controller 290, serving as a first measuring unit, measures (calculates) the diameter D of the first film roll R1*a* based on the first distance measured by the first sensor 285. For example, a distance between the first reference position and the conveying surface of the conveyor 210 (the surface on which the first film roll R1*a* is placed) is stored in advance in a storage device of the controller 290. The controller 290 calculates the diameter D of the first film roll R1*a* from the first distance and the distance from the first reference position to the conveying surface of the conveyor 210.

(4-2) Modification B

In the above embodiment, the controller 290 serving as a first measuring unit measures the diameter D of the first film roll R1*a*, and based on the diameter D of the first film roll R1*a*, the controller 290 controls the action of the second driving unit 236 to move the holding section 230 to a position where the height position of the center of the first film roll R1*a* held by the holding section 230 is aligned with the height of the center of the support shaft 114 of the bag making and packaging machine 3.

Figure 16:
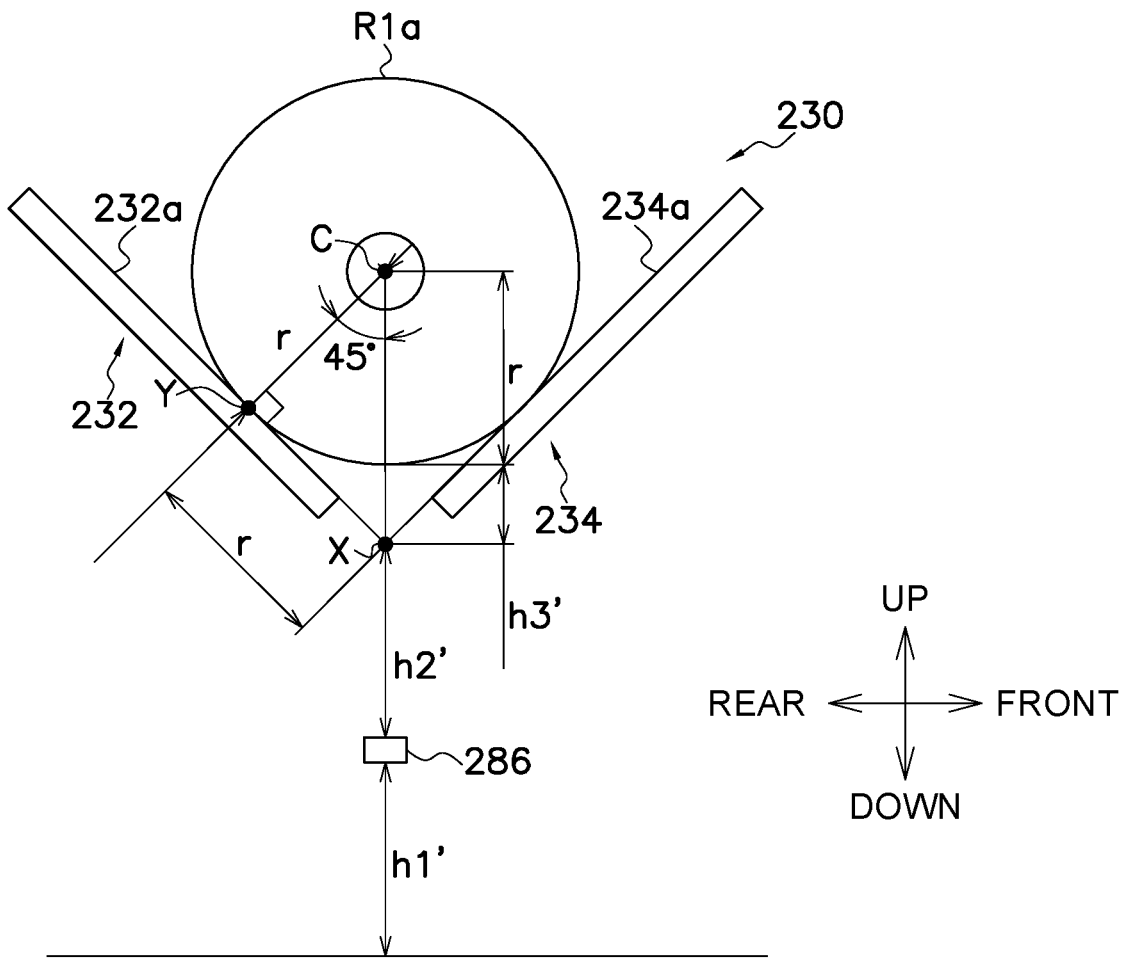
FIG. 16 is an enlarged view of the holding section of the film roll replacement device of Modification B, and is a drawing for illustrating a method of measuring the height position up to the center of the first film roll.

However, the controller 290 may measure the height position of the first film roll R1*a* held by the holding section 230 without measuring the diameter D of the first film roll R1*a*, and the controller 290 may use this measurement result as a basis to control the action of the second driving unit 236 to move the holding section 230 to a position where the height position of the center of the first film roll R1*a* held by the holding section 230 is aligned with the height of the center of the support shaft 114 of the bag making and packing machine 3. A specific example shall now be described with reference to FIG. 16. FIG. 16 is an enlarged view of the holding section 230 of the film roll replacement device 200, and is a drawing for describing the method of measuring the height position up to the center of the first film roll R1*a*.

In Modification B, the film roll replacement device 200 does not have the first member 280, the first-member-driving unit 282, or the encoder 284. In Modification B, the controller 290, serving as a second measuring unit, measures the height position of the center of the first film roll Ria held by the holding section 230. The controller 290 uses, for example, the measurement result from the distance sensor 286 previously described. In Modification B, the distance sensor 286 functions as a sensor that contactlessly measures a second distance from a second reference position (the position of the distance sensor 286) to the outer peripheral surface (the lowest part) of the first film roll Ria held by the holding section 230.

In the storage device of the controller 290 are stored, for example, a height h1' between the distance sensor 286 and the floor surface, and a height h2' between the distance sensor 286 and the intersection point X between the straight line imagined as an extension of the first holding surface 232*a* and the straight line imagined as an extension of the second holding surface 234*a* (see FIG. 16). It can be seen from the structure of the holding section 230 in the present modification that in a left-side view, the center C of the first film roll Ria, the intersection point X, and a line, the intersection point Y, that is extended from the center C of the first film roll Ria and that is perpendicular to the first holding surface 232*a* form a right isosceles triangle. Therefore, if the distance sensor 286 is able to measure a second distance (h2'+h3') from the position of the distance sensor 286 serving as the second reference position to the outer peripheral surface (the lowest part) of the second film roll Rib, the controller 290 can calculate the distance from the floor surface to the center C of the first film roll R1*a*, using the formula h1'+h2'+Root(2)×h3'/(Root(2)−1). The values of h1' and h2' are known, and the value of h3' can be calculated by subtracting the known value h2' from the second distance measured by the distance sensor 286.

In this modification, a case is assumed in which the angle formed by the first holding surface 232*a* and the second holding surface 234*a* is 90°, but the angle formed by the first holding surface 232*a* and the second holding surface 234*a* need not be 90°. In this case, the figure formed by connecting the center C of the first film roll R1*a*, the intersection point X, and the intersection point Y would not be a right isosceles triangle, but if the angle formed between the line segment joining the center C of the first film roll R1*a* and the line segment joining the intersection point X and the intersection point Y or the like is known, the height position of the first film roll R1*a* held by the holding section 230 can be measured (calculated) using a trigonometric function.

(4-3) Modification C

In the above embodiment, the first member 280 comes into contact with the outer peripheral surface of the first film roll R1*a* from above, but this feature is not provided by way of limitation. For example, the first member 280 may come into contact with the outer peripheral surface of the first film roll R1*a* from a side (e.g., from the rear). In this case as well, the controller 290 can measure the diameter D of the first film roll R1*a* using the same method as in the above embodiment.

(4-4) Modification D

In the above embodiment, the holding section 230, the right-side pushing member 240, and the left-side pushing member 250 are driven together by the third driving unit 237, but this feature is not provided by way of limitation. For example, the holding section 230, the right-side pushing member 240, and the left-side pushing member 250 may be driven by respective separate driving units. In addition, for example, one of the right-side pushing member 240 and the left-side pushing member 250 may together with the holding section 230 be driven by the third driving unit 237, and the other of the right-side pushing member 240 and the left-side pushing member 250 may be driven by a driving unit separate from the third driving unit 237.

(4-5) Modification E

In the above embodiment, the film roll replacement device 200 is a stationary device. However, the film roll replacement device 200 is not limited to being stationary, and may be, for example, a self-propelled device having wheels or another movement mechanism.

(4-6) Modification F

In the above embodiment, the controller 290 functions as a first measuring unit to measure the diameter of the first film roll, and in Modification B, the controller 290 functions as a second measuring unit to measure the height position of the center of the first film roll held by the holding section. However, this feature is not provided by way of limitation; the first measuring unit or the second measuring unit may be configured separate from the controller 290.

(4-7) Modification G

In the above embodiment, the controller 290 measures the diameter of the first film roll R1*a*, and adjusts the height position of the center of the first film roll R1*a* based on the measurement result. However, this feature is not provided by way of limitation; the controller 290 may, for example, adjust the height position of the center of the first film roll R1*a* based on a value of the diameter of the first film roll R1*a* input from an input device (not shown in the figure).

(4-8) Modification H

The winding-core-retrieving mechanism 270 need not be provided to the film roll replacement device 200. If the second film roll R1*b* is automatically removed from the second film roll R1*b* and the first film roll R1*a* is automatically attached to the support shaft 114, the winding-core-retrieving mechanism 270 is preferably provided to the film roll replacement device 200 in order to reduce the burden on the worker who takes away the second film roll R1*b* from the holding section 230 (the winding core WC of the depleted film roll R1).

(4-9) Modification I

If the winding-core-retrieving mechanism 270 is not provided and there is no need for the winding core WC of the depleted film roll R1 to fall from the gap 230*a* of the holding section 230, the holding section 230 may be a V-shaped member in which the first holding member 232 and the second holding member 234 of the above embodiment are integrated.

(4-10) Modification J

In the above embodiment, the holding section 230 is a V-shaped member, but the shape of the holding section 230 is not limited to that of a V. For example, the holding section 230 may be a flat plate-form member in which a groove extending in the left-right direction (a groove in which the film roll R1 will fit) is formed in the center in the front-rear direction.

(4-11) Modification K

In the above embodiment, it is assumed that the diameters of the replacement film rolls R1 (the first film roll R1*a*) are not uniform, but the film rolls R1 may all have the same diameter. In this case, there is no need for the second driving unit 236 to perform positioning of the height position of the center of the first film roll R1*a* held by the holding section 230 and the height position of the center of the support shaft 114 of the bag making and packaging machine 3.

The claimed invention is useful as a film roll replacement device to supply a film roll to a bag making and packaging machine, a film roll supply method to supply a film roll to a bag making and packaging machine, and a method for removing a film roll from a bag making and packaging machine.

REFERENCE SIGNS LIST

3 Bag making and packaging machine
112 Film-roll-supporting parts (supporting parts)
114 Supporting shafts
200 Film roll replacement device
230 Holding section
230*a* Gap
231*a* First end portion
231*b* Second end portion
236 Second driving unit (up-down direction driving unit)
237 Third driving unit (holding-section-driving unit, first-pushing-member-driving unit, third-pushing-member-driving unit, pushing-member-driving unit)
240 Right-side pushing member (first pushing member)
240*a* Recess
250 Left-side pushing member (second pushing member, third pushing member, pushing member)
250*a* Recess
252 Left-side pushing-member-driving unit (second-pushing-member-driving unit)
260 Stopper
270 Winding-core-retrieving mechanism (retrieval section)
286 Distance sensor (measuring unit)
290 Controller (control unit)
B Bag
F Film
R1 Film roll
WC Winding core

CITATION LIST

Patent Literature

[Patent Literature 1] Japanese Laid-open Patent Publication No. 2002-337817

The invention claimed is:

1. A film roll replacement device configured to supply a film roll, in which a film is wound around a hollow winding core, to a bag making and packaging machine that has a film-roll-supporting part to support a film roll and that uses the film to manufacture bags containing articles, the film-roll-supporting part having a supporting shaft that is configured to be inserted into the hollow winding core and that is configured to support the film roll, the film roll replacement device comprising:

a holding section that is configured to be located adjacent to the supporting shaft of the film-roll-supporting part of the bag making and packaging machine in a direction in which the supporting shaft extends and that is configured to hold the film roll supplied to the bag making and packaging machine;

a holding-section-driving unit configured to move the holding section; a control unit configured to control an action of the holding-section-driving unit to move the holding section in a first direction toward the film-roll-supporting part of the bag making and packaging machine and to transfer the film roll held by the holding section to the film-roll-supporting part;

a first pushing member; and a first-pushing-member-driving unit configured to move the first pushing member, the control unit being configured to control an action of the first-pushing-member-driving unit to move the film roll to the film-roll-supporting part by making the first pushing member push an end surface of the film roll held by the holding section, the first pushing member is configured to push at least an end surface of the winding core in the end surface of the film roll, the first pushing member being configured to move along the supporting shaft in a predetermined area, and a recess conforming to an outer shape of the supporting shaft is formed in the first pushing member.

2. The film roll replacement device according to claim 1, wherein the holding-section-driving unit is further configured to function as a first-pushing-member-driving unit, and the holding-section-driving unit is configured to move the holding section and the first pushing member together in the first direction.

3. The film roll replacement device according to claim 1, further comprising a second pushing member; and a second-pushing-member-driving unit configured to move the second pushing member in an up-down direction, wherein the holding section has a first end portion located on a side farther from the film-roll-supporting part in the first direction and a second end portion located on a side nearer to the film-roll-supporting part, on the side opposite to the first end portion;

the first pushing member is located adjacent to the first end portion;

the second pushing member is located adjacent to the second end portion; and the controller is further configured to, after making the first pushing member push the end surface of the film roll held by the holding section and moving the film roll to the film-roll-supporting part, control an action of the second-pushing-member-driving unit to move the second pushing member to a height position where the second pushing member is configured to contact with the end surface of the film roll moved to the film-roll-supporting part, and control the action of the holding-section-driving unit to push the end surface of the film roll by the second pushing member and to move the film roll in the first direction.

4. The film roll replacement device according to claim 1, further comprising a pushing back member; and a pushing-back-member-driving unit configured to move the third pushing back member in a second direction opposite to the first direction;

wherein the control unit is further configured to control an action of the pushing-back-member-driving unit to move the film roll to the holding section by making the pushing back member push the end surface of the film roll supported by the film-roll-supporting part.

5. The film roll replacement device according to claim 4, wherein a recess conforming to an outer shape of the supporting shaft is formed in the pushing back member.

6. The film roll replacement device according to claim 4, further comprising an up-down direction driving unit configured to move the holding section in an up-down direction; and a measuring unit configured to measure a distance in the up-down direction between the holding section and a surface of the film roll supported by the film-roll-supporting part;

wherein the control unit is further configured to control an action of the up-down direction driving unit to adjust a height position of the holding section based on the distance measured by the measuring unit before the film roll supported by the film-roll-supporting part is moved to the holding section.

7. The film roll replacement device according to claim 4, wherein the holding-section-driving unit is further configured to function as the pushing-back-member-driving unit, and the holding-section-driving unit is configured to move the holding section and the pushing back member together in the second direction when moving the film roll to the holding section by pushing the end surface of the film roll supported by the film-roll-supporting part with the third pushing back member.

8. The film roll replacement device according to claim 4, further comprising a retrieval section where the winding core of a depleted film roll is retrieved, wherein the holding section has a gap formed therein through which the winding core of the depleted film roll moved from the film-roll-supporting part is configured to fall to the retrieval section.

9. The film roll replacement device according to claim 8, wherein a stopper is positioned in the gap of the holding section, the stopper being configured to move between a first position where the winding core is prevented from falling into the retrieval section and a second position where the winding core is allowed to fall into the retrieval section.

10. A film roll supply method of supplying a film roll in which a film is wound around a hollow winding core to a bag making and packaging machine using a film roll replacement device, the bag making and packaging machine having a film-roll-supporting part configured to support the film roll and being configured to use the film to manufacture bags containing articles, the film-roll-supporting part having a supporting shaft that is configured to be inserted into the hollow winding core and that is configured to support the film roll, and the film roll replacement device having a holding section that is configured to be located adjacent to the supporting shaft of the film-roll-supporting part of the bag making and packaging machine in a direction in which the supporting shaft extends and that is configured to hold the film roll supplied to the bag making and packaging machine, a holding-section-driving unit configured to move the holding section, a first pushing member having a recess conforming to an outer shape of the supporting shaft, and a first-pushing-member-driving unit configured to move the first pushing member, the film roll supply method comprising steps of:

the holding-section-driving unit moving the holding section in a first direction toward the film-roll-supporting part of the bag making and packaging machine to transfer the film roll held by the holding section to the film-roll-supporting part;

the first-pushing-member-driving unit moving the film roll to the film-roll-supporting part by making the first pushing member push at least an end surface of the winding core in an end surface of the film roll, the first pushing member moving along the supporting shaft in a predetermined area.

11. A film roll removal method of removing a film roll in which a film is wound around a hollow winding core from a bag making and packaging machine using a film roll replacement device, the bag making and packaging machine having a film-roll-supporting part configured to support the film roll and being configured to use the film to manufacture bags containing articles, and the film roll replacement device having a holding section that is configured to be located adjacent to the bag making and packaging machine, a holding-section-driving unit configured to move the holding section, a pushing member, a pushing-member-driving unit configured to move the pushing member, and a measuring unit configured to measure a distance between the holding section and a surface of the film roll supported by the film-roll-supporting part; the film roll removal method comprising steps of:

the holding-section-driving unit moving the holding section to be below the film-roll-supporting part, the measuring unit measuring the distance between the holding section and the surface of the film roll supported by the film-roll-supporting part;

the holding-section-driving unit adjusting a height of the holding section based on the distance measured by the measuring unit, the pushing-member-driving unit driving the pushing member to bring the pushing member into contact with an end surface of the film roll supported by the film-roll-supporting part, and the pushing-member-driving unit driving the pushing member to push the end surface of the film roll in a first direction, and the holding-section-driving unit moving the holding section in the first direction from below the film-roll-supporting part, so as to move the film roll supported by the film-roll-supporting part to the holding section.

* * * * *